US008702474B2

(12) United States Patent
Suzuki et al.

(10) Patent No.: US 8,702,474 B2
(45) Date of Patent: Apr. 22, 2014

(54) METHOD OF REGENERATING A POLISHING PAD USING A POLISHING PAD SUB PLATE

(75) Inventors: Tatsutoshi Suzuki, Yokaichi (JP); Eisuke Suzuki, Yokaichi (JP)

(73) Assignee: Toho Engineering, Yokaichi (JP)

( * ) Notice: Subject to any disclaimer, the term of this patent is extended or adjusted under 35 U.S.C. 154(b) by 225 days.

(21) Appl. No.: 13/021,225

(22) Filed: Feb. 4, 2011

(65) Prior Publication Data

US 2012/0003903 A1 Jan. 5, 2012

(30) Foreign Application Priority Data

Feb. 4, 2010 (JP) ..... 2010-23601

(51) Int. Cl.
*B24B 1/00* (2006.01)

(52) U.S. Cl.
USPC ..... 451/56; 451/72; 451/443

(58) Field of Classification Search
USPC ..... 451/56, 72, 443, 444, 533, 538, 548, 451/550
See application file for complete search history.

(56) References Cited

U.S. PATENT DOCUMENTS

| | | | | |
|---|---|---|---|---|
| 6,517,426 | B2 * | 2/2003 | Lee | 451/537 |
| 6,620,036 | B2 * | 9/2003 | Freeman et al. | 451/533 |
| 7,160,181 | B2 * | 1/2007 | Jeung | 451/285 |
| 2004/0255521 | A1 * | 12/2004 | Jeung | 51/295 |
| 2008/0047841 | A1 * | 2/2008 | Manens et al. | 205/640 |

* cited by examiner

*Primary Examiner* — Timothy V Eley
(74) *Attorney, Agent, or Firm* — Kelley Drye & Warren LLP

(57) ABSTRACT

A method of regenerating a polishing pad for polishing semiconductor wafers is described wherein the polishing pad is removably stacked, aligned and fixed by a fitting ring to a polishing pad supporting surface of a polishing pad sub plate mounted on a central surface of a sub plate main body on an upper surface of a polisher rotation table and wherein the regeneration may include dressing, as well as cleaning, or regrooving the polishing pad surface.

5 Claims, 17 Drawing Sheets

METHOD OF REGENERATING A POLISHING PAD USING A POLISHING PAD SUB PLATE

PRIORITY

This application claims the benefit of priority to Japanese Patent Application No. 2010-023601, filed on Feb. 4, 2010, which is incorporated herein by reference in its entirety.

BACKGROUND OF THE INVENTION

The embodiments of the invention relate to technology for polishing substrates that are work pieces that require highly planar processing such as silicon wafer semiconductor substrates and glass substrates, and particularly it relates to technology making possible the achievement of regeneration of polishing pads used when polishing the surface of such substrates.

As is well known, when manufacturing semiconductors, polishing is carried out to planarize the substrate surface of silicon wafers, semiconductor substrates, glass substrates and the like comprising the constituent materials of semiconductors. Such polishing processes, generally, are carried out by polishing by directly fixing a disc shaped polishing pad made of synthetic resin material or the like atop the rotation table of the polisher with double sided tape, and while supplying polishing solutions containing polishing particles (grit) utilizing the mutually rotary motion of polishing pad and substrate Moreover, resin pads made of foamed or unfoamed polyurethane and the like may be used as the polishing pad for this kind of polishing process as described in Japanese Laid Open Patent Application 2002-11630 (hereby incorporated by reference as Patent Reference 1). Additionally, the polishing surface of such polishing pads, in many cases, is subjected to concentric or grid-like or radial grooving or the like, and the bubbles of the foamed resin are opened to the surface.

Furthermore, in polishing processes where a polishing pad is used, when the kind of substrate product that is the object of the polishing is changed, it is sometimes necessary to tear the polishing pad used in polishing from the rotation table and exchange it with another polishing pad. Moreover, for example, even in cases such as where a polishing pad that has been worn down during the polishing process is reprocessed by such means as putting grooves into the surface by separate processing equipment, it is necessary to tear the polishing pad off of the rotation table.

However, because resin pads in the form of a thin disc are securely fixed with adhesive tape to the rotation table of the polishing equipment, when these polishing pads are torn off of the rotation tables, damage to the polishing pad such as bending and breaking, wrinkling, tearing and the like are easily produced. For that reason, there exists the problem of it often being unavoidable to have to throw away such polishing pads before the end of their useful life without being able to reuse them.

Moreover, there is also a problem with the practice of tearing these polishing pads from the rotation table while exercising scrupulous care so as not to damage them, in that the operator must bear the considerable burden of the exercise of the requisite skill and caution. Additionally, because a considerable amount of time is required for the process of tearing the polishing pad off of the rotation table, there is also the problem that high value polishing equipment must be stopped over a long period of time and the operation time of the equipment is thus limited.

Japanese Laid Open Patent Application 2001-54859 (hereby incorporated by reference as Patent Reference 2) offers a structure in which, together with integrally forming a plate shaped support layer directly to the back surface of the polishing pad, by holding fast this support layer to the rotation table of the polishing device using magnetism or low pressure, it is possible to easily remove the polishing pad from the rotation table. However, not only is it difficult to form the support layer integrally directly onto the back surface of the polishing pad, but even if integral formation of the support layer with the polishing pad is obtained, there are yet problems in actual utilization.

Probably, in Patent Reference 2, examples of fixing the polishing pad to the rotation table using magnetism or reduced pressure are given, however, it is extremely difficult to exert sufficient magnetic force to introduce the thick rotation table to the thin support layer, and moreover, even in the case of the use of the force of low pressure, it is difficult to exert sufficient adsorptive force without forming a closed region between the planar support layer and the rotation table that is definitely cut off from the outside atmosphere. Again, additionally, in Patent Reference 2, a structure in which the back of the support layer is fixed to the rotary surface layer with tape is also disclosed, however, it is merely a thin planar support layer and covering the back surface of the polishing pad, and adequate stiffness is not achieved. When the supporting layer is torn off of the rotation table, just as with the simple structured polishing pad, such damage as bending and breaking and wrinkling and the like is produced.

Additionally, there is also the problem that whether with the polishing pad disclosed in Patent Reference 2 or the aforementioned polishing pad with the unitary structure referred to above, from the fact of having the simple circular shape, these are difficult and time consuming to center (centering) accurately on the rotation table.

SUMMARY EMBODIMENTS OF THE PRESENT INVENTION

The Problems the Invention is Intended to Solve

The embodiments of the invention offer a method of regenerating a polishing pad that makes possible the recycling of a polishing pad using a polishing pad sub plate, and, to offer a method of manufacturing a substrate by obtaining a substrate that has been polished by a polishing process using the said polishing pad sub plate.

DETAILED DESCRIPTION EMBODIMENTS OF THE INVENTION

Figure 1:
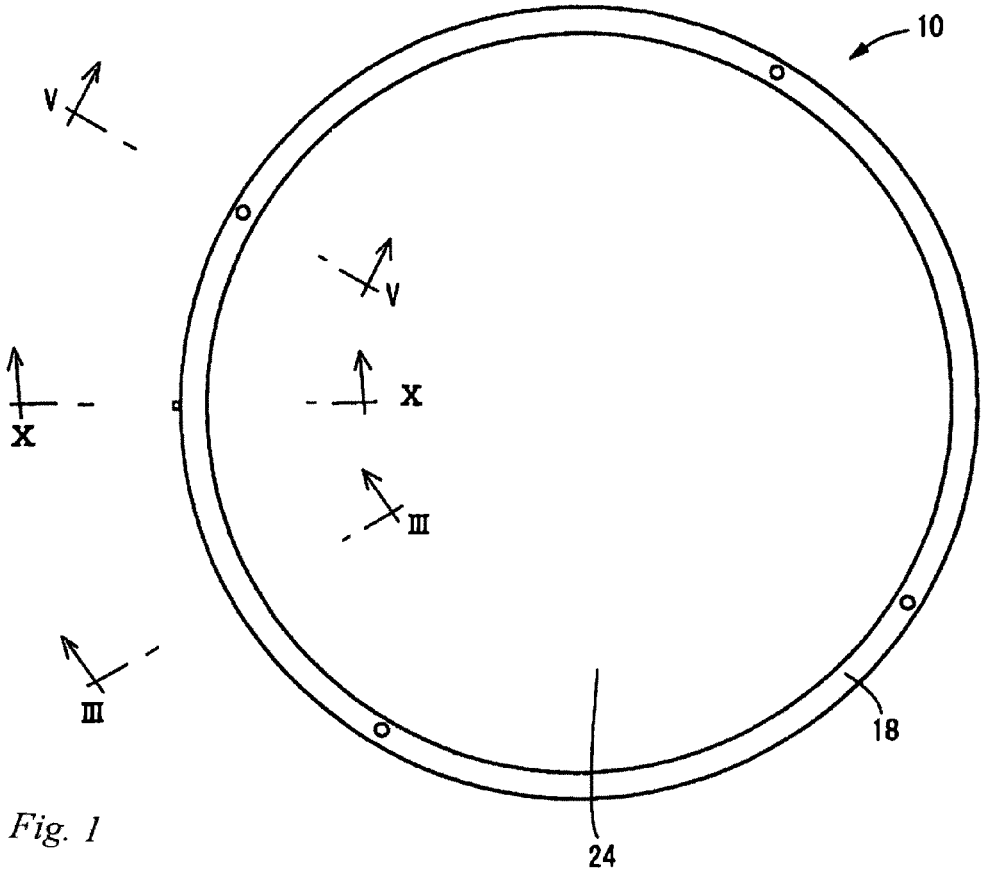
FIG. 1 is a horizontal drawing of the polishing pad sub plate in the embodiment practiced in the present invention.

The inventors in seeking to solve the problem of damage to polishing pads when they are removed from the rotation tables of polishers and to provide a safe, reliable, convenient and quick means by which different polishing pads may be placed upon and fixed to and subsequently removed from a rotation table, and additionally, to provide a safe, stable, reliable, effective and practical method for regenerating polishing pads have after considerable research and effort directed to solving these problems, discovered a device for the safe, reliable, convenient and quick placement and fixation of and subsequent removal of polishing pads from the rotation table of a polishing apparatus and methods for using the said device in polishing and in regenerating polishing pads.

More particularly the inventors have invented a method that in its embodiments enables the fast, safe and efficient regeneration of polishing pads that have been worn in polishing.

The apparatus of embodiments of the invention has been developed in response to the present state of the art, and in particular, in response to the problems and needs in the art that have not yet been fully solved by currently available polishing pad mounting systems for polishing tools and methods for recycling or regenerating used and worn polishing pads. Thus, it is an overall objective of embodiments of the invention to provide for superior CMP polishing pad placement, fixation, and removal to and from the polishing pad and practical regeneration of polishing pads and related methods that remedy the shortcomings of the prior art.

Embodiments of the present invention overcome the problems of the prior art by the use of a polishing pad sub plate characterized in that the said polishing pad fixed to a polishing pad support surface so that, by equipping the uppers surface of the rotation table of a polisher with a sub plate main body, together with creating a polishing pad support surface to which a polishing pad used in the polishing of semiconductor wafers is stacked, aligned and fixed by means of the central portion of surface of said sub plate main body, and by fashioning a fitting ring to the outer edge of the said sub plate main body, mated to the external circumference of the rotation table, and protruding in the downward direction guided by the external circumferential surface of the said rotation table of the polisher, it is possible for the said polishing pad to be detached from the rotation table. The pad fixed to the polishing pad sub plate may be then be successfully regenerated either by placing it in a reforming tool and reforming it or by reforming it in situ on the rotation table in instances where the polishing tool is suitably equipped.

Through the use of the polishing pad sub plate an embodiment of the present invention, polishing pads may be safely, quickly, rapidly, conveniently and efficiently placed upon, fixed to and removed from the rotation table without damage and may additionally be easily and practically regenerated.

All dimensions for parts of an embodiment of the present invention follow are based on a pad size of about 20" to 30" in diameter and a wafer size of between [8"] and [12"] in diameter and may be altered as needed in proportion to changes in the size of the polishing pad and wafer used. The specific dimensions given herein are in no way limiting but are by way of example to demonstrate an effective embodiment of the invention.

The embodiment of the invention is a method for using a polishing pad sub plate characterized in that the said polishing pad fixed to a polishing pad support surface so that, by equipping the uppers surface of the rotation table of a polisher with a sub plate main body, together with creating a polishing pad support surface to which a polishing pad used in the polishing of semiconductor wafers is stacked, aligned and fixed by means of the central portion of surface of said sub plate main body, and by fashioning a fitting ring to the outer edge of the said sub plate main body, mated to the external circumference of the rotation table, and protruding in the downward direction guided by the external circumferential surface of the said rotation table of the polisher, it is possible for the said polishing pad to be detached from the rotation table. The polishing pad attached to the said polishing pad sub plate may then be removed and placed in a reforming tool and the polishing pad regenerated or it may be regenerated in situ in polishers so equipped.

In order to solve the aforementioned problem, the first embodiment of the present invention relating to the polishing pad sub plate, is a polishing pad sub plate mounted so that the sub plate main body is mounted on the upper surface of the rotation table of the polisher, and, together with the configuration of the pad support surface to which the polishing pad used in the polishing of semiconductor substrates is mounted, aligned and fixed by the central part of the surface of the body of the polishing pad sub plate, and by forming a fitting ring that protrudes downward along the line of the outer surface of the rotation table of the said polisher at the outer edge of the said sub plate main body and engage the periphery of the said rotation table, the said polishing pad fixed to the said pad support surface can be removed from the said rotation table surface.

Additionally, the embodiment of the present invention widens the surface of the aforementioned rotation table upon which the aforementioned sub plate main body is stacked and aligned in the polishing pad sub plate, and provides a contact layer that improves the contact between the surfaces of the said rotation table and the said stacked and aligned sub plate main body mounted on it.

In the present embodiment, by the use, for example, of adhesive tape as the contact layer, it is possible to obtain effective fitting strength of the sub plate main body to the rotation table. In particular, because the area of the sub plate main body is larger than that of the polishing pad, it is possible to greatly alter the adhesive tape, and by so doing plan further improvement in the fixing strength, and it is further possible thereby to plan to improve releasibility by setting the adhesive strength per unit area of the adhesive tape at a small value and thus facilitating removing it.

Moreover, a tape or a film or plate (for example a silicone sheet) with elastic properties may be used as the contact layer, and waxes or adhesive materials or gels and the like may be applied as coating and used as well. By using this kind of thin elastic layer or coating, the contact between the sub plate main body and the rotation table is improved, the accumulation of residual air between their surfaces is prevented, and it is possible to improve the effectiveness of strengthening of and support of the sub plate main body by the rotation table. Moreover, in the event that a cushion layer is to be supplied in the aforementioned embodiment, the sub plate main body fixing adhesive tape becomes the said cushion layer comprising a component of the sub plate main body.

Additionally, the present embodiment possesses an air removal channel connecting the outer air with the internal space between the rotation table and the sub plate main body. When mounting the polishing pad sub plate on the rotation table, it is possible due to the air removal channel to avoid the spring back phenomenon caused by air trapped in the aforementioned internal space, and to fix easily the sub plate main body to the rotation table (without experiencing the bad effects of air trapped in the internal space).

In the polishing pad sub plate of the embodiment of the invention, by forming the fitting ring of the outer edge of the body of the sub plate, special technical effects recorded in each of (1) to (6) below are demonstrated.

(1) The polishing pad, fixed to the upper surface (upper surface) of the body of the sub plate, together with the sub plate main body, can be mounted and removed from the rotation table surface. Moreover, even in the event that the polishing pad is removed from the rotation table surface, and cleaned or recycled or the like, it is possible to do this under the condition that the polishing pad is fixed to the sub plate main body's upper surface.

(2) Using the fitting ring it is possible to demonstrate very effective reinforcing effects on the sub plate main body. In particular, the fitting ring, because it is formed on the periphery on the outside of the upper surface of the polisher's rotation table surface, while avoiding deleterious effects on the polishing and similar processing carried out on the rotation table, fitting rings may be formed in every size and type, and it is possible to obtain effective reinforcement effects upon the sub plate main body. Additionally, on the occasion of the aforementioned (1), by tearing off the polishing pad under conditions whereby it is affixed to the sub main body, then during the removal of the polishing pad from the rotation table surface, and of course when cleaning or recycling the polishing pad, and even when transporting the polishing pad or storing it or the like, it is possible to prevent bending and damage to the polishing pad and to preserve it in optimum condition.

(3) By guiding the inner surface of the fitting ring using the outer edge of the Rotation table surface when the fitting ring is fitted to the Rotation table surface, the sub plate main body fixed to the polishing pad may be mounted and aligned under conditions preserving its roughly parallel orientation to the upper surface of the rotation table. For this reason, in parallel with the reinforcement effect by the fitting ring, deflection and tilt of the polishing pad and the sub plate main body are prevented and it is possible to realize very effectively stable support in which the polishing pad and the sub plate main body are precisely aligned and fixed to the upper surface of the rotation table.

(4) Based on the fitting arrangement of the fitting ring to the rotation table, the polishing pad that is fixed to and aligned by the fitting ring may be mounted easily and precisely aligned with the center of the rotation table.

(5) Together with preventing damage to the polishing pad as stated in (1)-(2) above, it is possible to achieve the results of being able to precisely and quickly remove the polishing pad precisely aligned according to (3)-(4) aforementioned from the rotation table, of there no longer being unnecessary limitation of precision polishing preparation operation time expended to detach the polishing pad and the like, thereby increasing the production efficiency of substrates (polishing efficiency) by increasing the operation efficiency of polishing preparation.

(6) Because as a result of the synergy of (1)-(5), for example, the problems encountered when recycling polishing pads are solved, it is possible to realize a practical level of recycling of polishing pads even by persons without special skill or knowledge. That is to say, for example, even such practices as reuse of polishing pads that were detached once from the rotation table when making an exchange of the kind of substrate or the like, or reuse after recycling of polishing pads that have been detached once from the rotation table through recycling them by preparing or enhancing grooves in the pad surface using separate equipment as a measure in response to wear of the polishing pad, can be considered at a practical level.

Additionally, in this embodiment, the "sub plate main body" supports the polishing pad, and the strength and stiffness required when performing every sort of process such as processes using the polisher other than polishing, dressing the polishing pad surface, cleaning, re-grooving and the like, where the requirements for structural stability and precision should be satisfied, the material and thickness measurements utilized are not limited. In particular, the said sub plate main body, by itself, does not carry the support strength and stiffness and the like, because for example, when polishing, it is used aligned upon the top of the rotation table of the polisher and it is supported on the back side by the rotation table, so its great strength or stiffness are not required in the sub plate main body to so great a degree. For that reason, in addition to metals like stainless steel, synthetic resins or fiber reinforced resins and the like also may be used as the material of the sub plate main body. Particularly, sub plate bodies made of synthetic resin are lighter and easier to process and handle compared with those made of metal, and, for example, materials such as polycarbonate possess the superior features of dimensional stability of thickness and of low distortion in response to temperature change. However, it is preferred that the sub plate main body have greater stiffness than the polishing pad.

Moreover, the sub plate main body should cover at least the polishing pad placement area on the upper surface of the rotation table, however, it is not necessary for the upper surface of the rotation table that it be covered completely over its entire extent. Concretely, in the said sub plate main body, if the part of the polishing pad that exceeds the edge of the placement region of the polishing pad has an appropriate size, then notches or openings and the like may be present.

Again, in the main embodiment, the "fitting rings" may be formed consolidated with the sub plate main body or may be made separately and fixed later to the sub plate main body. The said fitting ring may also be made using any type of material the same as with the sub plate main body. Particularly, the fitting ring does not require the precision of measurements of the sub plate main body, and, for example, it is also possible to form the fitting ring and the like by a distributed structure whereby the several parts are oriented to mate in a circumferential or a downward direction.

Moreover, because there is an added benefit if the fixing effect of the "fitting ring" to the sub plate main body and the effect of fixed reinforcement by the sub plate main body with respect to the rotation table can be combined, then inevitably, it is not necessary to form the fitting ring continuously around the entire edge of the sub plate main body. Concretely, for example, it is all right to form a fitting ring having a distributed structure formed on the outer edge of the sub plate main body, mutually separated in the circumferential direction. Moreover, it is possible to form the fitting ring with partially differing forms.

Moreover, in the event that the sub plate main body is fixed to the rotation table of the polisher using adhesive tape, it is desirable that it possess a fixing strength (units of fixing strength divided by area) less than the polishing pad's adhesive tape fixing strength to the sub plate main body. By that means, the polishing pad sub plate may be easily removed from the rotation table. Then, even if the fixing strength of the sub plate main body to the rotation table is small (compared to the fixing area of the polishing pad sub plate main body), it is possible to set it larger even than for the fixed area of the sub plate main body to the rotation table, and because such things are possible as utilizing the combined position determining effects of the fitting ring to the rotation table or utilizing the combined fixing effects of different methods to fix the polishing pad sub plate to the rotation table and the like, it is possible to equip the polishing pad sub plate to the rotation table with sufficient fixing strength.

The second embodiment of the present invention is the first embodiment of the present invention where the aforementioned sub plate main body is equipped with a cushion layer on the back side, and this cushion layer is stacked on top of the aforementioned rotation table.

In the present embodiment, the polishing pad's support characteristics can be adjusted based on the elasticity of the cushion layer exerted on the polishing pad through the sub plate main body. That is to say, by adjusting the elasticity of the said cushion layer and the strength or stiffness of the sub plate main body, it is possible to adjust the support of the rotation table for the polishing pad and by doing so, planning the improvement of uniformity of polishing efficiency within the surface of the polishing pad.

In particular, two layer polishing pads formed by a cushion layer on the back side of the polishing pad for the purpose of obtaining uniformity over the entire polishing pad have been offered in the past. In this case, even if the cushion layer on the polishing pad is not used as such, in the present embodiment, it is still possible to obtain uniformity of polishing efficiency within the surface that is superior to that of single layer polishing pads. Alternatively, when using a two-layer polishing pad, by providing the polishing pad a cushion layer, and having the cushioning layer provided to support to the back of the sub plate main body to further promote the sustained effect of a cushion layer, when the polishing pad is re-used, long-term stabilization of the polishing characteristics of the polishing pad can be achieved.

Furthermore, in addition, in the event that a cushion is supplied to the back surface of the sub plate main body in the aforementioned embodiment number eight, by, for example, including a liquid such as water in the said cushion layer, it is possible to use the cushion layer as the contact layer. That is to say, in the event that the said cushion layer is a multi-porous material with extensive internal spaces, it is possible to use this positively to plan to improve the contact characteristics of the sub plate main body with the rotation table.

Moreover as the fixing method of the sub plate main body to the rotation table of the embodiment of the invention, it is possible, for example, to use, other than the aforementioned adhesive tape, negative pressure by such means as low pressure air or magnetic pull by such means as permanent magnets or electromagnets. Moreover as the means of fixing the fitting ring to the rotation table, it is possible to use, for example, such means as the fastening bolts.

Additionally, by providing a means of fixing the rotation table of the polisher to the fitting ring, it is possible to avoid the necessity of providing a means of fixing the sub plate main body to the rotation table, and the fixing strength may be reduced by the method of fixing the sub plate main body to the rotation table. Here, the fitting ring, as compared with the sub plate main body is not limited for the most part in shape or dimensional accuracy, and it is possible to use any type of fixation means. Fixing means that exert a large fixing strength and fixing means that excel in the operability of their fixation or removal, may be used freely with a great degree of freedom of design. Particularly, the fitting ring may be fixed to the rotation table with a sub plate main body to a greater degree of strength compared with the sub plate main body, and by extending this fixing strength to the outer circumferential edge of the sub plate main body, it passes to the entirety of the sub plate main body and it is possible to exert a large fixing strength effectively onto the rotation table.

Now, the third embodiment of the present invention comprises the polishing pad sub plate of the aforementioned first and second embodiments, and, when wear by use of the aforementioned polishing pad has reached a certain point, application of cleaning and regeneration processes to the polishing pad attached to the said polishing sub plate either on the rotation table or removed and fixed on separate facilities provided for that purpose.

According to the method of an embodiment of the invention, even when the regeneration process to the pad is effected, because the reinforcement effect continues to be demonstrated by the polishing pad sub plate fixed to the back surface, damage to the polishing pad is effectively prevented, and it is possible to realize a very precise, practical regeneration process.

Moreover, the concentric grooves of the front surface of the aforementioned polishing pad are enhanced or supplied during the regeneration process of the said polishing pad, and when the aforementioned regeneration process is carried out, it is desirable to remove anything that has adhered to or come to rest in the grooves.

Moreover, when removing things that have adhered to or come to rest in the grooves, the application of pressurized air or the process of cleaning with a brush and the like may be employed. It is more preferred that, for example, a comb-like regenerating tool equipped with appropriate pitch and appropriately sized multiple teeth already formed to correspond to the grooves be used, and by placing these multiple teeth in each groove and moving them along the grooves, the preferred method of forcing these adhering materials out of the grooves is achieved.

Moreover, also characteristic of the aforementioned first and second embodiments are methods for mounting the polishing pad sub plate of those embodiments on the rotation table of the polisher and creates a polishing process for substrates as the material to be polished by which substrates may be polished using a polishing pad sub plate with a structure characteristic of the embodiment. Thus, according to this method of manufacturing substrates, with the polishing process as its objective, it is altogether less expensive, since it is possible to regenerate the polishing pads, and possesses a superior process effectiveness, and it is possible to advantageously manufacture polished substrates while thus dramatically improving the operational efficiency of the polisher.

Effects of Embodiments of the Invention

As aforementioned, according to embodiments of the invention, it is possible while preventing damage to the polishing pad, to remove the polishing pad from the rotation table using a superior process, and, as a result, valuable operational time is not unnecessarily limited by operations to remove the polishing pad and the improvement of manufacturing efficiency of substrates through the improvement of operational efficiency of the polishing equipment is achieved.

Additionally, as a result, it is possible to realize practical, cost effective levels of regeneration of the pads.

Embodiments for the Practice of the Invention

Below, in the practice embodiments of the present invention, explanation is made while referring to the drawings. To begin with, in FIGS. 1 through 3 polishing pad sub plate 10 is shown as one embodiment for the practice of the present invention. This polishing pad sub plate 10 is used mounted on rotation table 12 of a well known polisher.

Concretely, the said polishing pad sub plate 10 is equipped with sub plate main body 14 possessing a thin circular flat (disc) shape, and possesses both the flat upper surface 14*a* and flat lower surface 14*b*. This sub plate main body 14 is advantageously formed from a sheet of stainless steel or the like or resin such as polycarbonate. Moreover, the external diametrical dimensions of sub plate main body 14 are made to be the same as or slightly larger than those of the diametrical dimensions of rotation table 12 on which it is mounted. Thus, by mounting polishing pad sub plate 10 on rotation table 12, sub plate main body 14 is stacked, aligned and mounted on the upper surface 16 of rotation table 12. By this the entirety of the upper surface 16 of the rotation table 12 is covered by sub plate main body 14.

Additionally, fitting ring 18 may be formed integrally extending in the direction of the circumference with the edge on the outer edge of sub plate main body 14. This fitting ring 18, extends in the circumferential direction possessing a block shaped cross section (rectangular shaped cross sections in the present embodiment) thinner, therefore, than the sub plate main body 14, and is formed in a circular shape extending continuously across the entire circumference in the direction of the circumference in the present embodiment of the invention. Moreover, just as with sub plate main body 14, in addition to a metal such as stainless steel, fitting ring 18 may be made from synthetic resins and the like. In particular, in the present embodiment of the invention, fitting ring 18 is formed integrally with the outer edge of the sub plate main body 14.

The said fitting ring 18, when polishing pad sub plate 10 is mounted on rotation table 12 and sub plate main body 14 is aligned, stacked and mounted on the upper surface 16 of rotation table 12, stretches out to cover the outer circumferential surface of rotation table 12. Particularly, in the present embodiment, the inner surface 20 of fitting ring 18 is made in the shape of a cylinder, and this inner surface 20 is mated and fit snuggly or distributed across a slight gap to the outer circumferential surface 22 of rotation table 12. Moreover, by making a slight gap of appropriate size between the inner surface 20 of fitting ring 18 and the outer circumferential surface 22 of the rotation table 12 it becomes easier to fix and remove the polishing pad sub plate (10?) to and from rotation table 12. Furthermore, although it is not shown in the drawings, by providing a gradually tapering or slope resulting in greater width between the lower extremities of inner surface 20 of the fitting ring 18 and the outer circumferential surface of rotation table 12, fitting ring 18 can be designed so that the facility of the operation of mating it with rotation table 12 is improved.

Moreover, polishing pad 24 is stacked and aligned on and attached to surface 14*a* of sub plate main body 14. As the said polishing pad 24 it is possible to use any polishing pad known to the prior art. Moreover, the lower surface of the said polishing pad 24 is fixed to surface 14*a* of sub plate main body 14 using adhesive tapes or appropriate adhesives known to the prior art. Furthermore, the external diametrical dimensions of polishing pad 24 may be generally of any value, but, in most cases, are smaller than the external diametrical dimensions of upper surface 16 of the rotation table 12 on which it is mounted. In the present embodiment, by making the external circumferential dimensions of, for example, the surface 14*a* of sub plate main body 14 larger than the external circumferential dimensions of rotation table 12, it becomes possible to use a polishing pad 24 that is the same size or slightly larger than the external diametrical dimensions of rotation table 12.

That is to say, by mounting polishing pad sub plate 10 on rotation table 12 and stacking and aligning sub plate main body 14 with upper surface 16 of rotation table 12, polishing pad 24, fixed to the surface 14*a* of sub plate main body 14, is set in a fixed condition mounted on upper surface 16 or rotation table 12 through sub plate main body 14. Therefore, by the rotary motion along the central axis of rotation table 12, polishing pad 24 also rotates simultaneously, having been centered and mounted on rotation table 12, and a polishing process for substrates (not shown) is accomplished.

Figure 4:
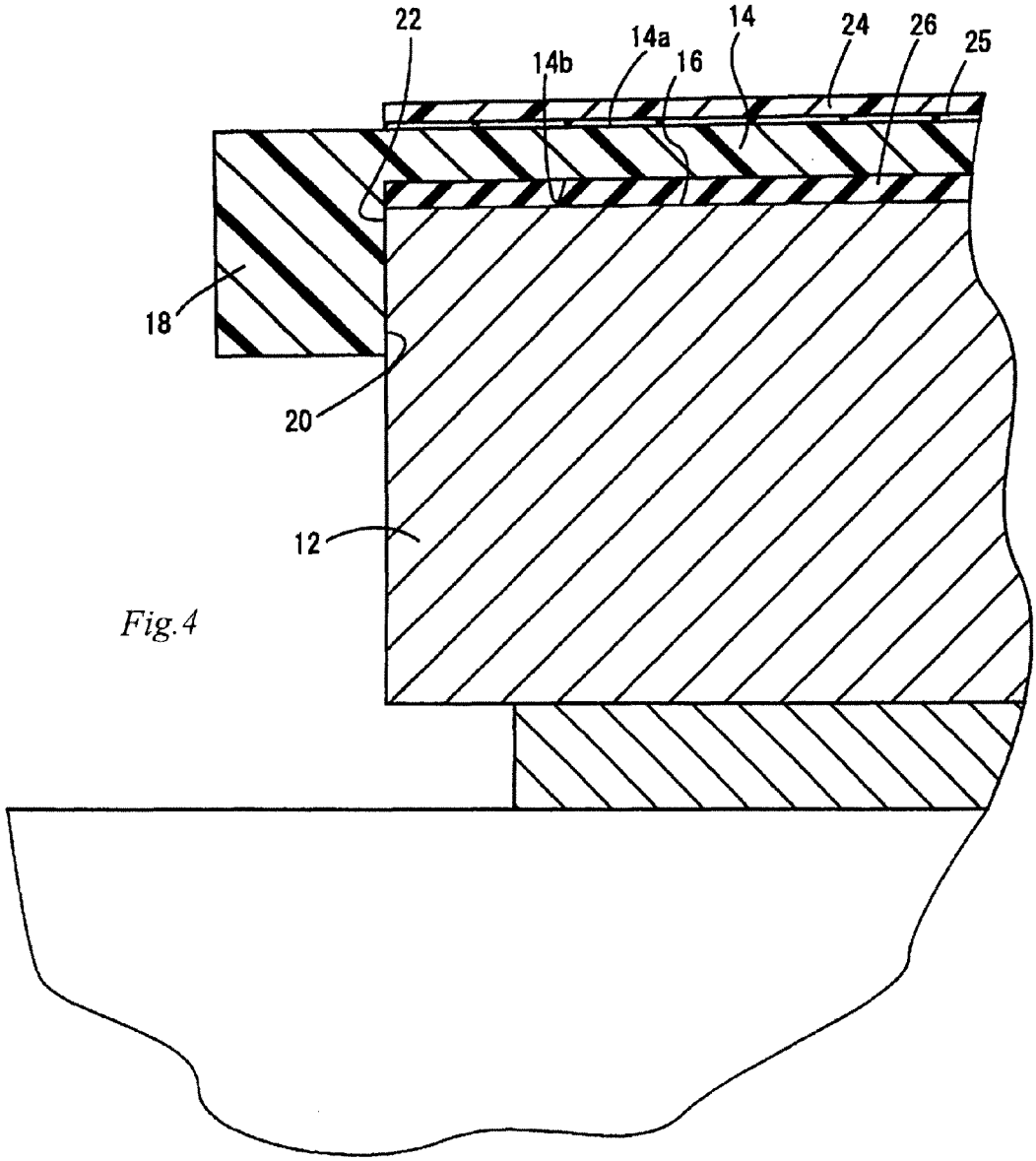
FIG. 4 is a cross sectional drawing of the same location as FIG. 3 showing the polishing pad sub plate in a separate embodiment practiced in the present invention.

Then, as is shown in, for example, FIG. 4, between the upper surface 16 of rotation table 12 and sub plate main body 14, it is possible to install an appropriate cushion layer 26. Moreover, as the said cushion layer 26, for example, a resin sheet in which, due to its having been foamed, a certain amount of compression is possible, an elastomeric sheet, a rubber sheet or the like may all be preferably used. The said cushion layer 26, because it prevents distortion locally in sub plate main body 14, by being large enough to cover the entire fixed region of polishing pad 24, preferably is formed possessing a fixed thickness extending over the entire back surface 14*b* of sub plate main body 14.

When polishing using polishing pad 24, by providing this kind of cushion layer 26, it is possible to design for uniformity effective polishing of the substrate across the entire surface. In this connection, as compared with the case where cushion layer 26 is not provided, by practicing the embodiment with cushion layer 26, in relation to the uniformity of polishing effectiveness within the surface of 300 mm oxide layer surfaced substrates, whether at the start of polishing or after eight hours, the achievement of improvements on the order of 10% has been observed. Moreover, in other applications of embodiments of the invention, where a double layer structure polishing pad (for example, Nitta Paas Made IC1400) formed by unifying a commercially available cushion with the back surface and cushion layer 26 was not provided to surface 14*b* of sub plate main body 14 and variations in the surface of approximately 1000 Angstroms of polishing volume per minute were observed, as compared with applications where cushion layer 26 was added to back surface 14*b* of sub plate main body 14, and it has been observed that the variation in the polishing volume is limited to a few hundred Angstroms per minute.

Moreover, during polishing, polishing pad sub plate 10 to which polishing pad 24 is fixed, because fitting ring 18 is mated with the outer circumferential surface 22 of rotation table 12, defects due to the removal of polishing pad 24 by pulling polishing pad sub plate 10 from rotation table 12 are effectively prevented.

Figure 5:
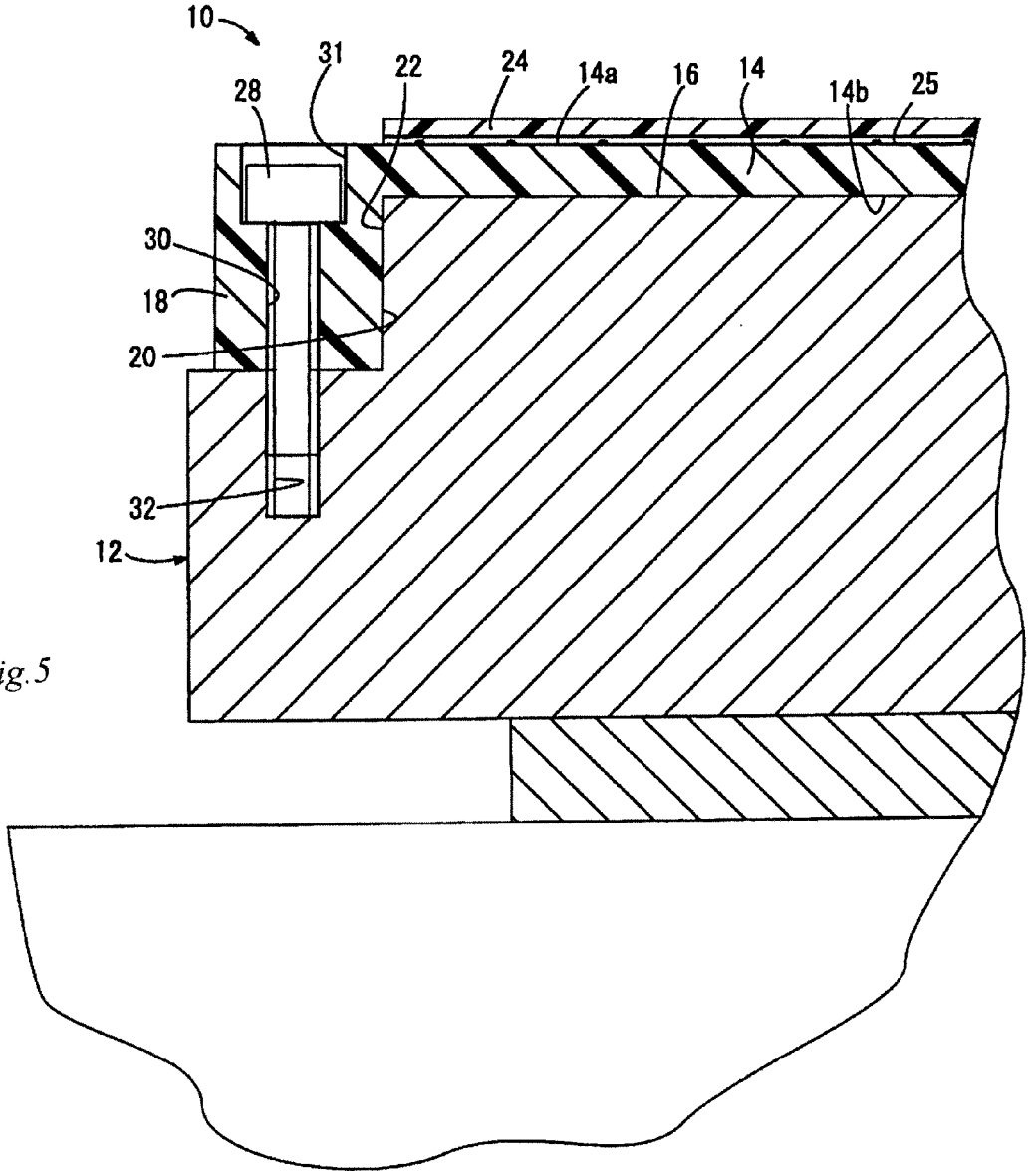
FIG. 5 is a cross sectional drawing along line V to V in FIG. 1.

Moreover, polishing pad sub plate 10 may be fixed to rotation table 12 based on frictional force and the like when, for example, mating fitting ring 18 to rotation table 12, and, preferably, when special fixing methods are used. As the said fixing method, such things as adhesive tape or adhesives may be used, and in the embodiments of the invention shown in FIGS. 1-3, fastening bolts 28 may be used as shown in FIG. 5.

These fastening bolts 28 are inserted into bolt free holes 30 formed through various locations on the circumference (preferably three or more distributed evenly around the circumference) in the respective axial directions. Moreover, by housing the heads of fastening bolts 28 in housing depressions 32 formed in the fitting ring 18, they are prevented from protruding from surface 14*a* of sub plate main body 14 onto which polishing pad 24 is mounted.

Therefore, fastening bolts 28 tips (downward pointing tips) inserted into bolt free holes 30, by being screwed into bolt holes 32 formed in rotation table 12, tighten fitting ring 18 onto rotation table 12 and fix fastening bolts 28. Moreover, in FIG. 5, together with advantageously ensuring the contact over the entire surface of sub plate main body 14 with the upper surface 16 of rotation table 12, to ensure the effective fixing strength by fastening bolts 28 of fitting ring 18 to rotation table 12, the setting is made such that a slight gap is allowed to remain between the axial face of rotation table 12 and the lower axial face of fitting ring 18, even if fastening bolts 28 are fully tightened, and it may be desirable to use a spring washer or the like as needed.

Figure 6:
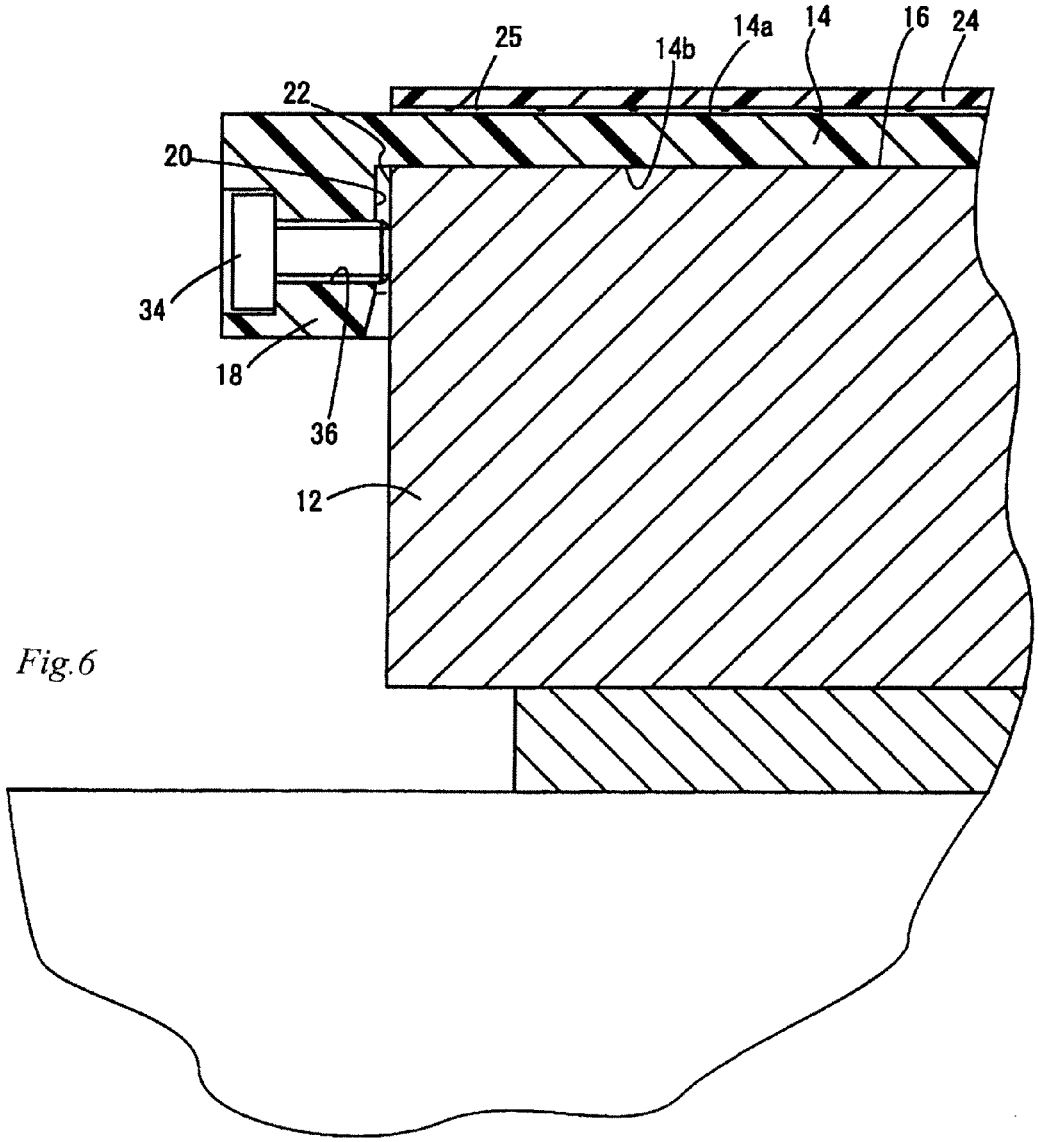
FIG. 6 is a cross sectional drawing through FIG. 5 showing the polishing pad sub plate in yet a separate embodiment practiced in the present invention.

Moreover, as the fastening bolts used as the fixing means to fix fitting ring 18 to rotation table 12, in addition to fastening bolts 28, that are screwed into the separate parts affixed to rotation table 12 and are rotated integrally with it or to rotation table 12 itself, into which are each inserted in the axial direction of the aforementioned fitting ring 18; for example, as shown in FIG. 6, it is acceptable to use fastening bolt 34 that has been screwed transversely into the fitting ring 18.

That is to say, in the separate practice embodiment shown in FIG. 6, bolt holes 36 are formed in the fitting ring in multiple locations along the circumference perpendicular to the axis, and into these bolt holes 36 are screwed the respective fastening bolts 34 from the outer edge. Thus, the tip of each fastening bolt 34 is brought into contact with outer surface 22 of rotation table 12, and by the concerted action of the several fastening bolts 34, a fitting strength based on the tightness in the transverse direction is exerted between fitting ring 18 and rotation table 12.

As shown in FIG. 6, if a plurality of fastening bolts 34 are screwed in the horizontal direction and used, under the conditions allowing relative displacement of the fitting ring 18 to the rotation table 12 by a large predetermined amount of the inner diameter of fitting ring 18 in respect to the external diameter of rotation table 12, by mutually adjusting the extent of the degree of screwing in of these several fastening bolts, it is possible to adjust the mutual transverse position (centering and the like) of the polishing pad sub plate on the rotation table 12. Moreover, in the event that the several fastening bolts 34 are used in this way, by setting the screwing position of each fastening bolt 34 in the bolt hole 36 by stamping, it is possible to more easily carry out centering when mounting polishing pad sub plate 10 on rotation table 12.

Figure 7:
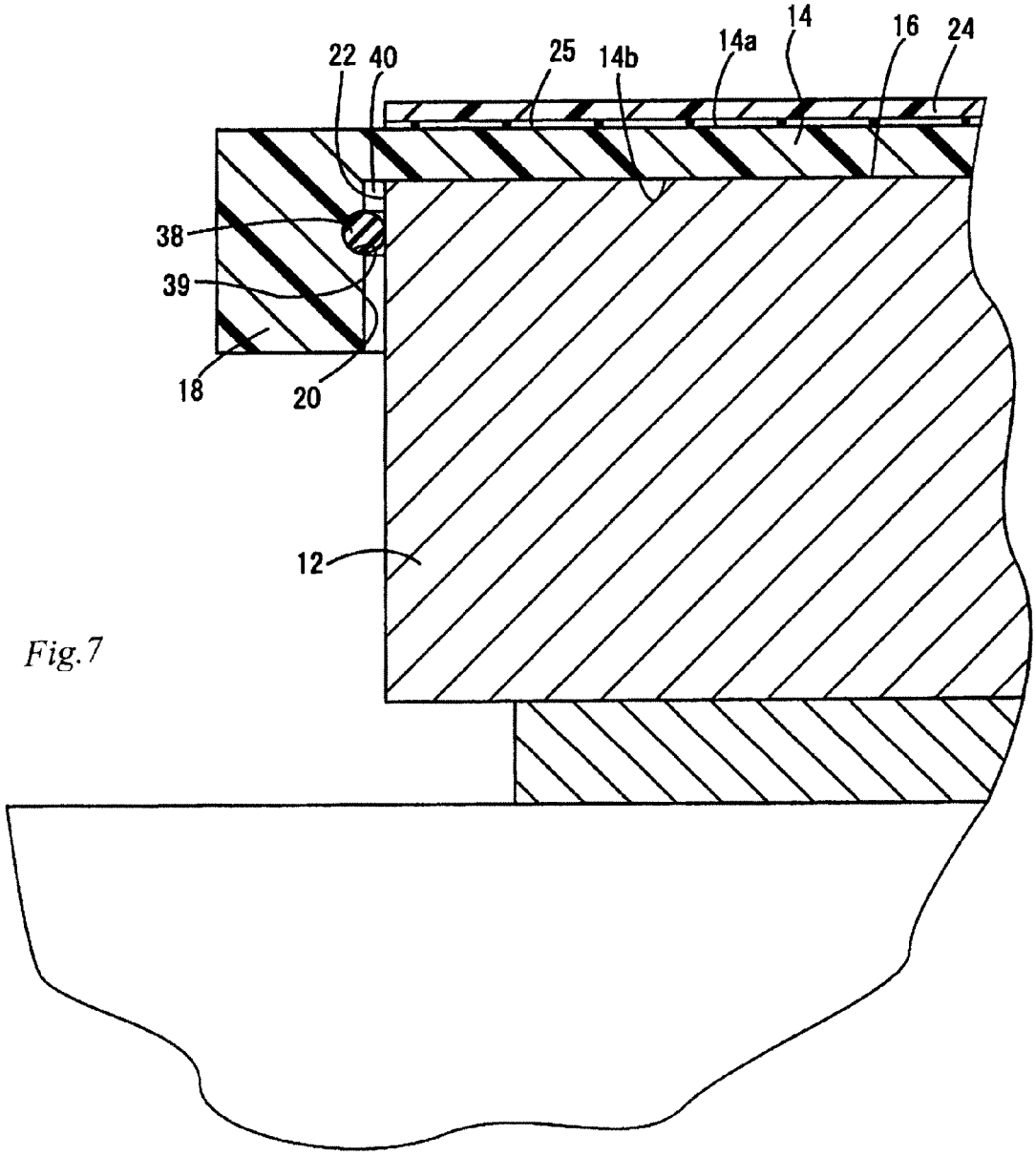
FIG. 7 is a cross sectional drawing through FIG. 3 showing the polishing pad sub plate in yet a separate embodiment practiced in the present invention.

Moreover in the separate embodiment shown in FIG. 7, an O ring 38 as a sealing material made from elastic material is mounted extending continuously around the entire circumference in the circumferential direction of the outer surface 22 of rotation table 12 and the inner surface 20 of fitting ring 18. Moreover, in the present embodiment, the mounting circumferential groove 39 is formed on the inner surface 20 of fitting ring 18, and the outer edge of O ring 38 has its position determined and is mounted by placing it in circumferential groove 39.

Particularly, in this embodiment of the present invention, it is possible to seal, preventing access from the outside air, an internal space 40 that exists including the space between sub plate main body 14 supporting polishing pad 24 and the surface of rotation table 12 upon which it is stacked and aligned. By doing this, contaminants are effectively prevented from entering this said internal space 40 while sub plate main body 14 and rotation table 12 are fixed together and problems like a limited degree of contact between sub plate main body 14 and the rotation table 12 being inadequate are likewise effectively prevented.

However, because it is spread across the entire circumference, the said O ring 38 based on its elasticity, can automatically center fitting ring 18 on rotation table 12.

Figure 8:
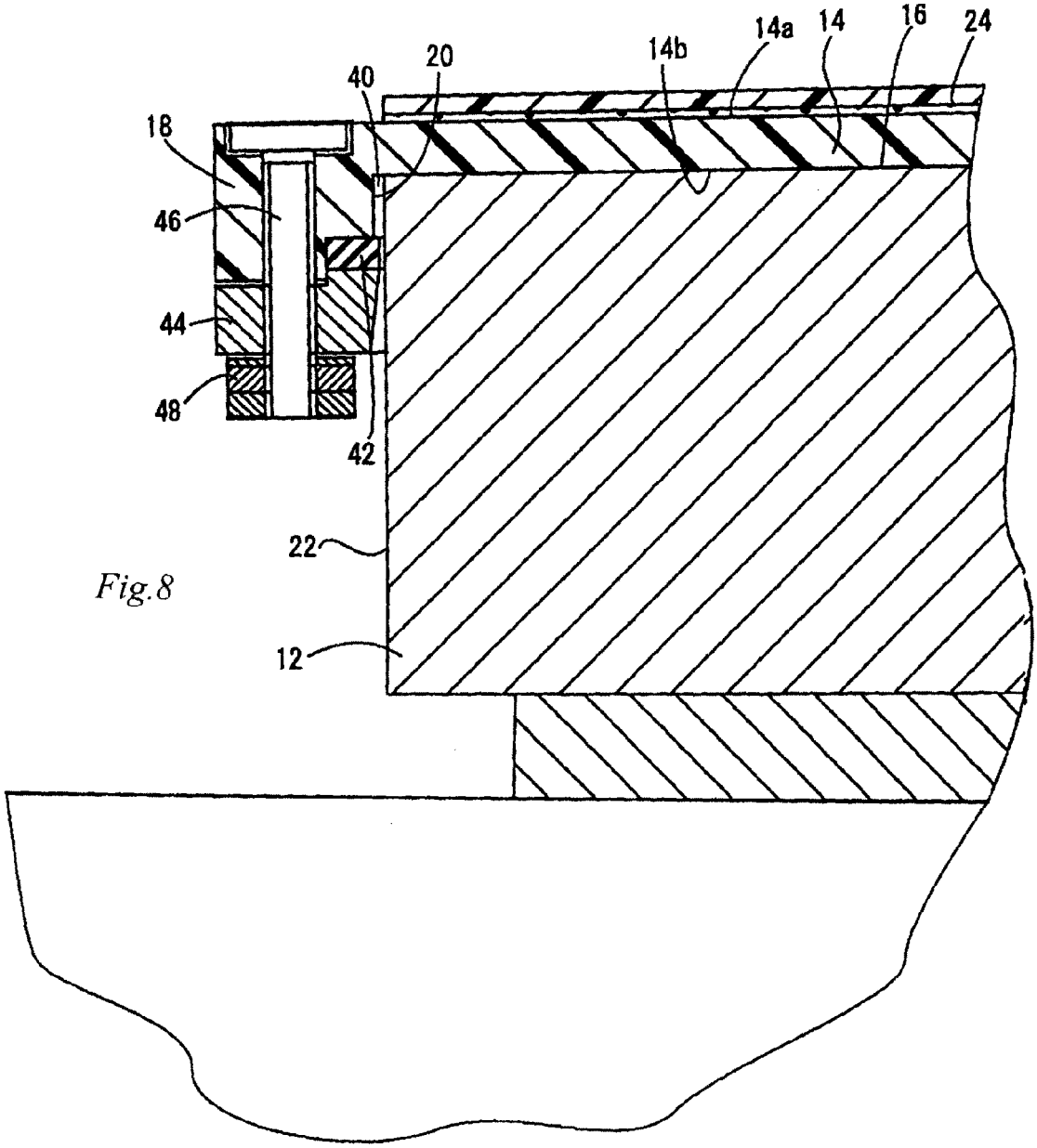
FIG. 8 is a cross sectional drawing through FIG. 3 showing the polishing pad sub plate in yet a separate embodiment practiced in the present invention.

Moreover , as the seal material, in place of the aforementioned O ring 38, it is possible, as a separate embodiment as shown in FIG. 8, to use annular elastic body 42 made of elastic material. In the present embodiment, the annular pressing member 44 that presses to close from the bottom (in the present embodiment, it has a circular shape and is continuous around the entire circumference) is stacked and aligned upon the fitting ring 18. Therefore, between the facing surfaces of fitting ring 18 and the annular pressing member 44, annular elastic body 42 extending across the entire circumferential direction is disposed to narrow the internal circumferential edge.

Moreover, tightened fastening bolts 46 passing through in the axial direction in a plurality of fixed locations along the circumference press against annular elastic member 44 and fitting ring 18. These tightened fastening bolts 46 have their heads locked on the upper surface of fitting ring 18, put the fitting ring 18 into play in the axial direction, and are screwed into the annular pressing body 44. According to this, by tightening the fastening bolts 46 to the annular pressing body 44, pressure is exerted in the direction (axial direction) of stacking and aligning the fitting ring on the annular pressing body. Moreover, the tips (lower tips) of tightened fastening bolts 46 protrude further in the downward direction from the annular pressing member 44 and locknuts 48 (double locknuts) are screwed on the protruding tip portions. These locknuts 48 demonstrate the failsafe of preventing annular pressing body 44 from being removed and falling off from tightened fastening bolts 46.

Figure 9:
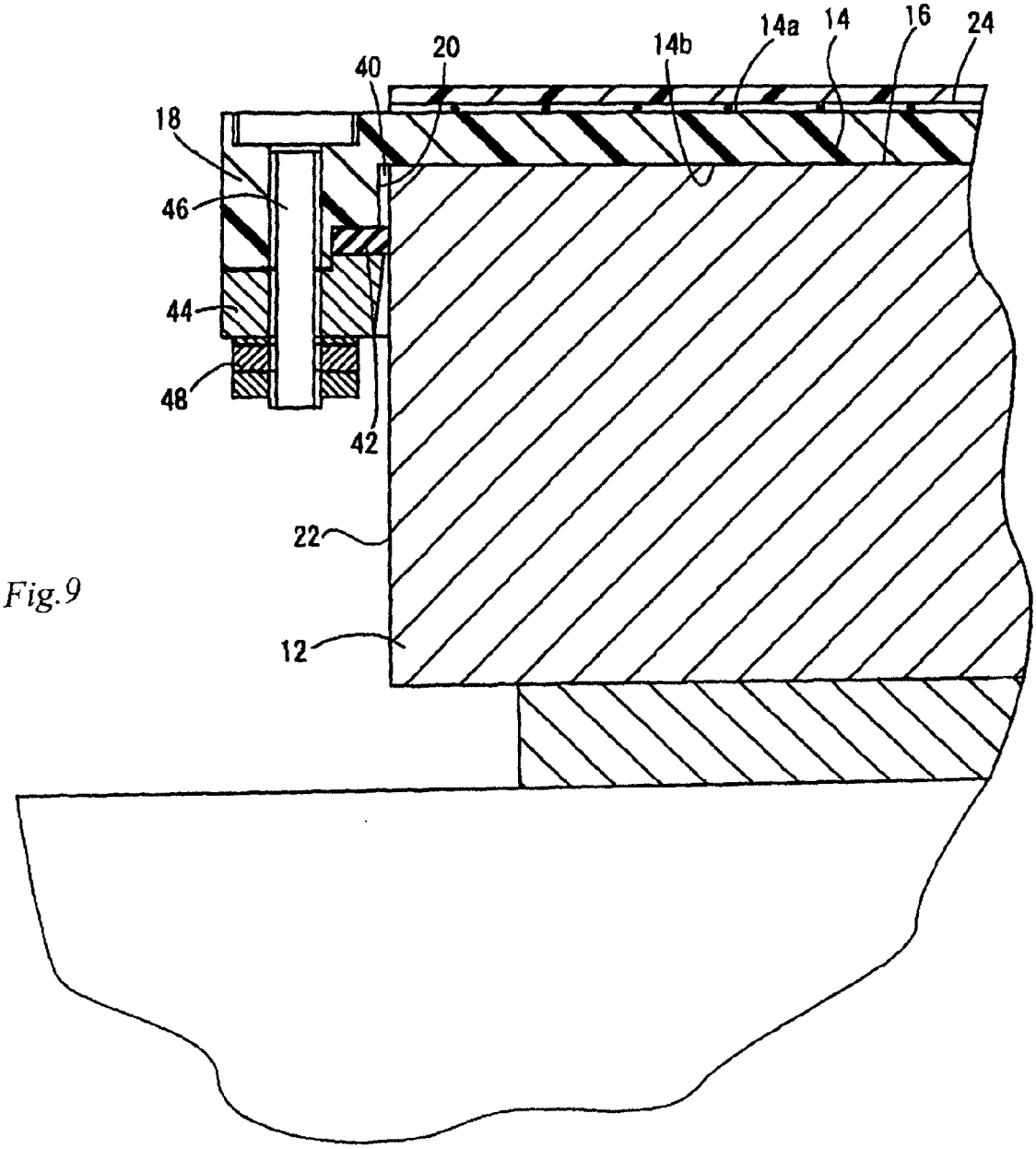
FIG. 9 is a cross sectional drawing showing the circumstances of the seal in the polishing pad sub plate shown in FIG. 8.

Therefore, as shown in FIG. 9, by pressure in the axial direction from the tightening force of the said tightened fastening bolts 46 and locknuts 48, fitting ring 18 and annular pressing body 44 are mutually brought nearer one another and pressed in the direction they are aligned and stacked, and compression is exerted in the axial direction on annular elastic body 42 mounted between these two members, 18 and 44. By this means, annular elastic body 42 (particularly in the present embodiment, this is a parallel initiative together with preventing the manifestation of elastic bulging deformation to the outer circumferential edge) in response to the amount of compression in the axial direction, manifests a bulge deformation protruding radially inward, and, as a result, the inner circumferential edge of annular elastic body 42, is pressed to the outer circumferential surface 16 of rotation table 12, and in turn, by these means, the said part serves as a seal against the flow of fluids.

Particularly in this way by the seal structure using annular elastic body 42, by adjusting the tightening of fastening bolts 46, it is possible to adjust the pressing force of the annular elastic body 42 onto rotation table 12, and, therefore, for example, when removing the polishing pad sub plate from the rotation table 12, it is also possible to improve the process of removing or lessening the contact between the annular elastic body 42 and the rotation table 12. That is to say, the force of contact from the annular elastic body 42 to the rotation table 12 can be used to fix fitting ring 18 to rotation table 12.

Figure 2:
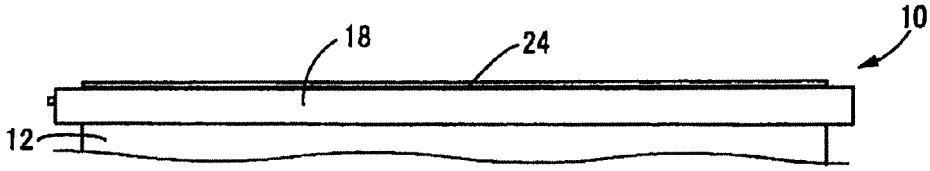
FIG. 2 is a frontal drawing of the polishing pad sub plate shown in FIG. 1.
Figure 3:
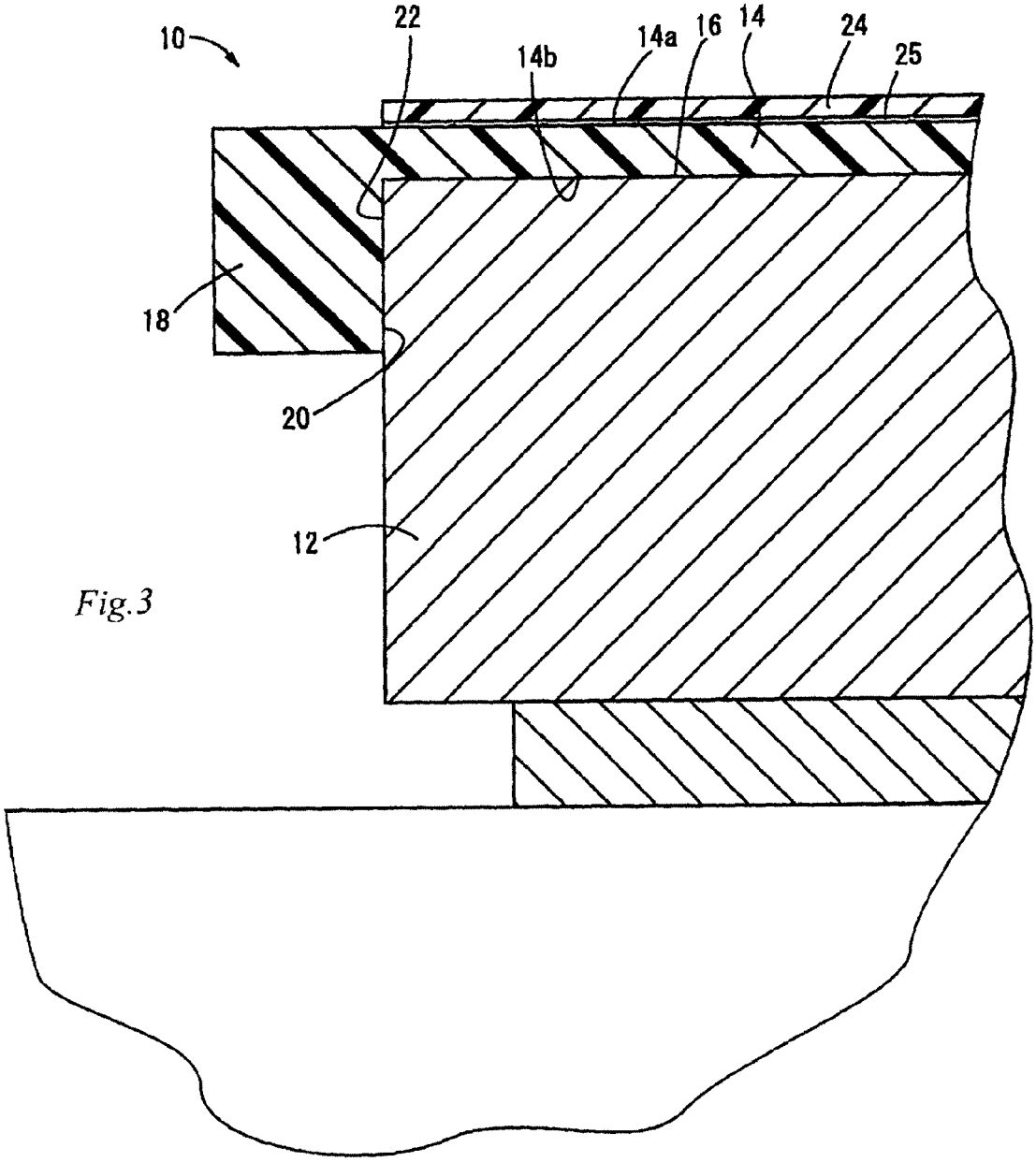
FIG. 3 is a cross sectional drawing from III to III in FIG. 1.
Figure 10:
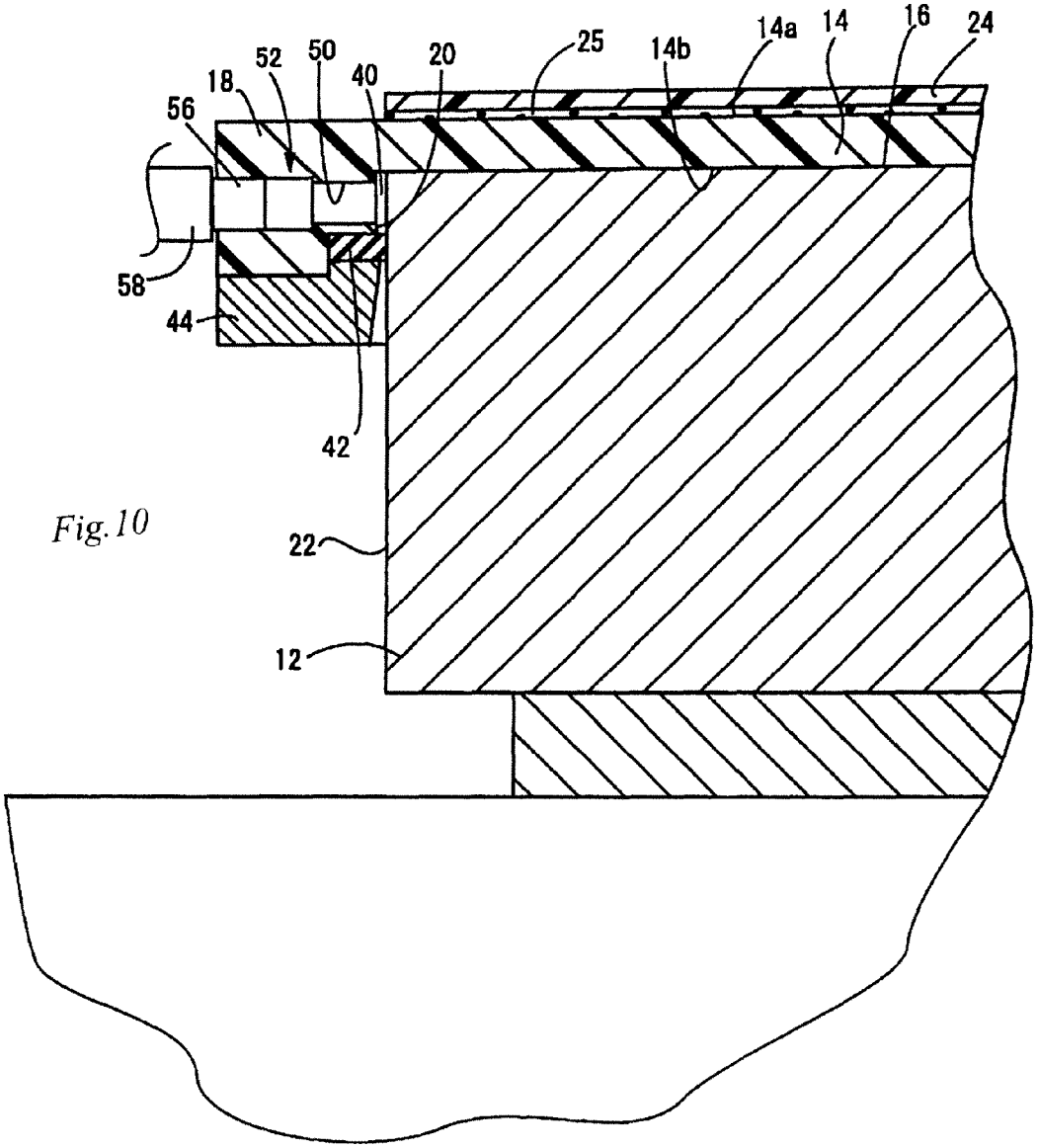
FIG. 10 is a cross sectional drawing showing the negative pressure part in the polishing pad sub plate shown in FIG. 9.

In the embodiment of the present invention shown in FIGS. 1-3, a compressed fluid pass 50 is formed extending through from the inside to the outside (Refer to FIG. 10 showing a cross section from X-X in FIG. 1). Moreover, a pressurized air line is removably connected to this compressed fluid pass 50, and air pressure from an outside pressurized air source can be introduced through the said pressurized air line. In this way, for example, negative air pressure can be exerted between the stacked and aligned the upper surface 16 of rotation table 12 and sub plate main body 14 to forthrightly remove any residual air from between these stacked and aligned plates and it is thus possible to plan the improvement of the contact between these stacked and aligned surfaces. Alternatively, by exerting positive air pressure in the space between the stacked and aligned upper surface 16 of rotation table 12 and sub plate main body 14 and thereby exerting a separating force between the stacked and aligned surfaces, this improves the removability of polishing pad sub plate 10 from rotation table 12 and can prevent the entry of contaminants between the stacked and aligned surfaces.

Particularly, in the embodiment of the invention, when this kind of air pressure device is provided, the O ring shown in the aforementioned FIG. 7 or a sealing part comprising the annular elastic ring shown in FIGS. 8-9 may used and the closed internal space 40 may be formed, and it is desirable to be able to exert air pressure on this internal space 40. Concretely, for example, as shown in FIG. 10, under the conditions of the formation of the internal space closed by the seal part comprising the annular elastic body 42 shown in each of FIGS. 8 and 9, compressed fluid pass 50 opening into internal spaces 40, is formed in the radial direction through fitting ring 18.

In the compressed fluid pass of an embodiment of the present invention, together with the incorporation of one touch connector 52, the said one touch connector 52 is equipped with connection aperture 56 that constitutes an internal component of the valve body. Thus, external pipeline 58 is connected to this connection aperture 56, and by this means, using one touch connector 52, it is possible to easily remove external pipeline 58 from the compressed fluid pass 50 (both connection and disconnection are possible). Particularly, when the one touch connector 52 is disconnected from external pipeline 58, the compressed fluid pass is closed by means of the internal valve and the closed condition of internal space 40 is preserved.

Therefore, compressed fluid pass 50 passing into external pipeline 58 may be connected to a suitable negative pressure source such as a negative pressure pump or negative pressure accumulator (not shown). Moreover, in external pipeline, together with supplying an open-shut valve or a changeover valve as needed, it is good also to make possible selectively the connection of the said external pipeline to the negative pressure source or positive pressure source (for example positive pressure pumps or positive accumulators or the like) through a changeover valve.

When, in the case of supplying a compressed fluid pass 50 that has been structured in this way, for example, polishing pad sub plate 10 is mounted on rotation table 12, by connecting external pipeline 58 to connection aperture 56 and exerting negative pressure on internal space 40, together with aligning and stacking upper surface 16 or rotation table 12 with sub plate main body 14 under conditions of a high degree of contact, while maintaining negative pressure in internal space 40 by later disconnecting external pipeline from connection aperture 56, it is possible to avoid such problems as the negative effects of the external pipeline on the rotary operation of rotation table 12.

Figure 11:
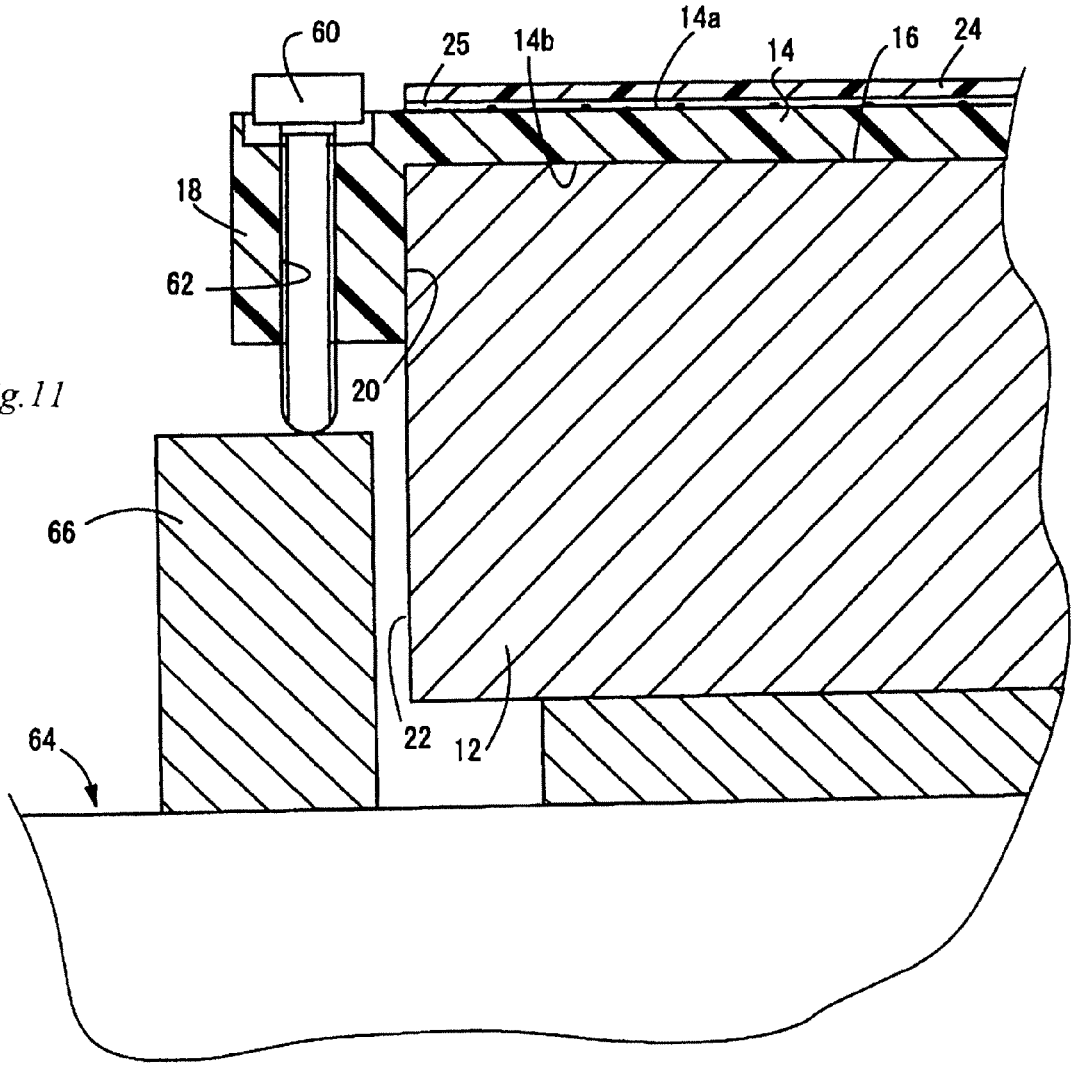
FIG. 11 is a cross sectional drawing showing the polishing pad sub plate in yet a separate embodiment of the present invention.

Furthermore, FIG. 11 shows yet another embodiment of the present invention. That is to say, in the present embodiment, jack-bolts 60 are attached as jacking means to several positions around the circumference of fitting ring 18. These jack-bolts 60 are screwed in through screw holes 62 formed through the fitting ring in the axial direction, and possess shaft length dimensions longer than the through screw holes 62. The tips of jack-bolts 60 that protrude downward from through holes 62 are contacted to contact blocks 66 projected to facing parts of the polisher main body 64 equipped with rotation table 12. As a result, by adjusting the extent to which jack-bolts 60 projecting downward from the peripheral wall parts are screwed in, and thus adjusting the extent to which the jack-bolts project downward from the fitting ring 18, it is possible to adjust appropriately the distance in the axial direction separating the surface of sub plate main body 14 from the upper surface 16 of rotation table 12.

As a result, when, for example, mounting polishing pad sub plate 10 on rotation table 12, by loosening the several jack-bolts 60 set around the circumference little by little, while preserving easily and precisely the horizontal condition of sub plate main body 14, it is possible to maintain its parallel condition with and gradually approach the upper surface 16 of rotation table 12. By doing this, while avoiding such problems as partially sealing in air between the surfaces and the relative slope of the surfaces of sub plate main body 14 to the upper surface 16 of rotation table 12, it is possible to obtain advantageously a condition of contact in which the respective surfaces are stably stacked and aligned.

Moreover, when removing polishing pad sub plate 10 from rotation table 12, by tightening the several jack-bolts 60 set around the circumference little by little, it is possible to exert efficiently force in the direction of separating sub plate main body 14 which is in contact and the like with upper surface 16 of rotation table 12 from rotation table 12. By this, it is possible to quickly and easily effect the tearing off from rotation table 12 of the sub plate main body 14, even in the event, for example, that it is affixed with adhesive tape.

Figure 12:
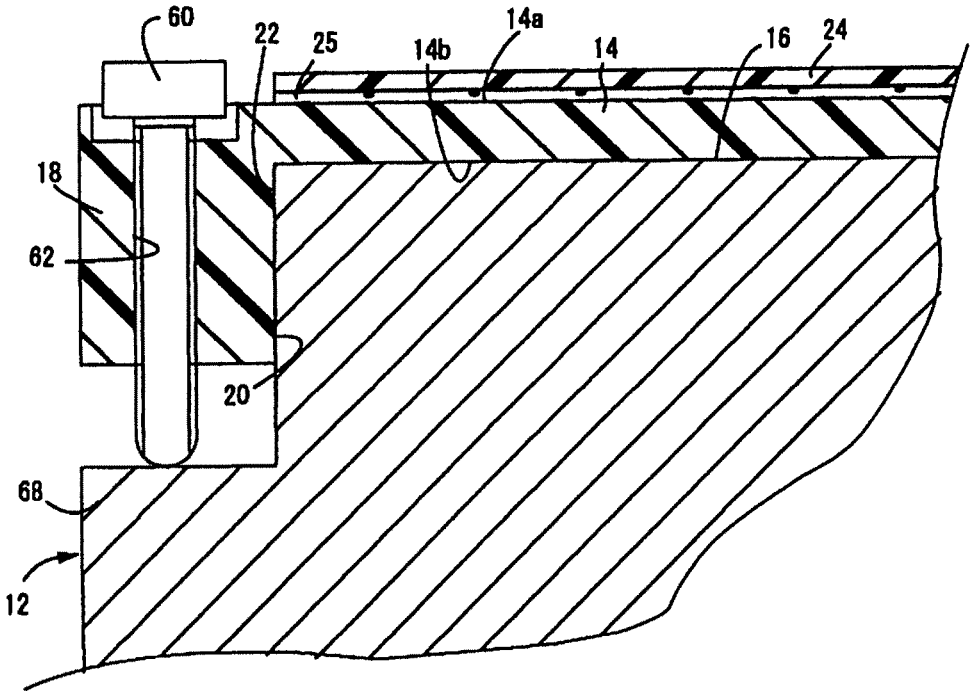
FIG. 12 is a cross sectional drawing showing the polishing pad sub plate in yet a separate embodiment of the present invention.

Moreover, contact block 66 that contacts the protruding tips of jack-bolts 60 may, be formed as contact projections 68 protruding upon the surface of the external circumference of rotation table 12, as shown in FIG. 12, alternative to formation on the body of the polisher as shown above. These contact projections 68 are formed integrally with rotation table 12 and protrude from the outer circumferential surface downward in the axial direction of rotation table 12 in positions to contact each of jack-bolts 60 along the circumference or extend across the entire extent of the circumferential direction.

Figure 13:
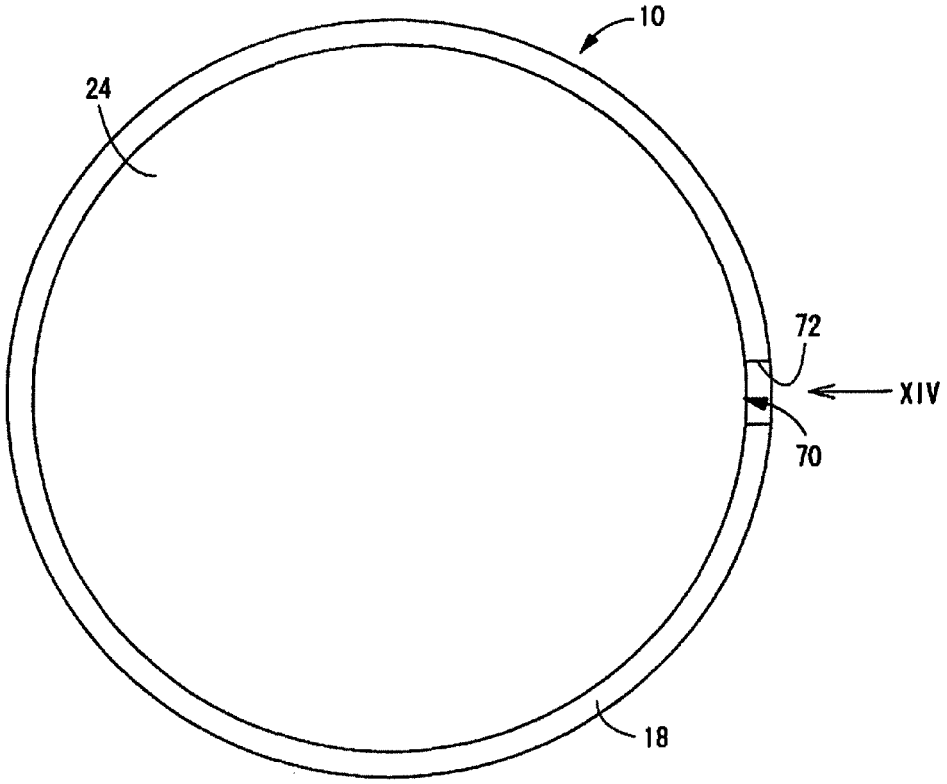
FIG. 13 is a cross sectional drawing showing the polishing pad sub plate in yet a separate embodiment of the present invention.
Figure 14:
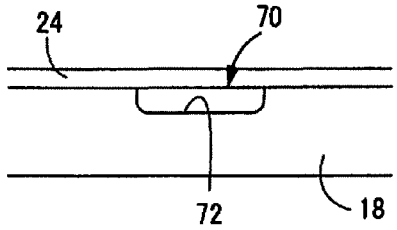
FIG. 14 is a drawing explaining arrow XIV in FIG. 13.
Figure 15:
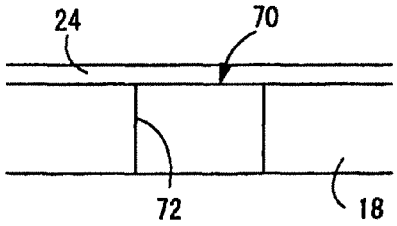
FIG. 15 is a drawing explaining FIG. 14 showing a separate example of the embodiment of the non-contact part shown in FIG. 14.

In addition, in an embodiment of the invention, as shown in FIGS. 13 through 15, when polishing pad 24 is in contact with, stacked on, aligned and fixed to the surface 14*a* of sub plate main body 14 in polishing pad sub plate 10, it is preferred that there be formed a non-contact part 70 in at least one location along the circumference of the outer circumferential edge of polishing pad 24. The embodiments shown in FIGS. 13 through 15 are formed by uniting with the said non-contact part 70, a depression 72 extending from fitting ring 18 radially inward to surface 14*a* of sub plate main body 14 reaching the outer circumferential edge of the fixed region of polishing pad 24.

By providing this kind of depression, when removing polishing pad 24, the operator, by inserting beneath and catching the lower surface of polishing pad 24 with their finger or an appropriate tool can easily accomplish the procedure. However, in the part formed by depression 72, in a small part of the region of the outer circumferential edge of polishing pad 24, by forming a part (non-contact part 70) not fixed by adhesive tape, it is possible to easily begin the separation operation of polishing pad 24 from the said non-contact part 70. Moreover, in addition to forming depression 72 only on top of the upper edge of fitting ring 18 as is recorded in FIGS. 13 and 14, it is possible to form depression 72 in any shape so that it notches the outer circumferential edge of the fitting ring through the entire axial direction length as is shown, for example, in FIG. 15. However, this depression 72 is formed only on the outer surface in the fitting ring 18 or the sub plate main body 14, and does not pass through to the inner part. As a result, it is possible to ensure the air tightness of the internal space 40. Moreover, this kind of depression 72, may also be use as an air removal (channel) when mounting polishing pad 24 on the surface 14*a* of sub plate main body 14.

Figure 16:
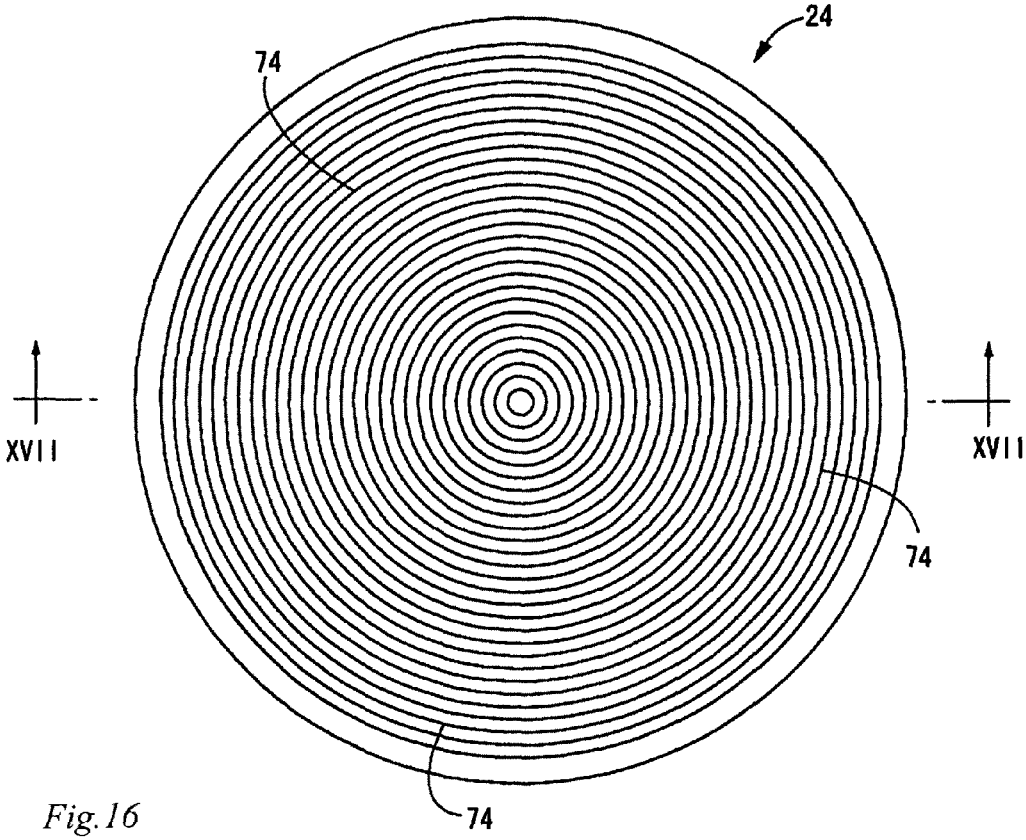
FIG. 16 is a horizontal drawing showing the polishing pad sub plate in yet a separate embodiment practiced in the present invention.

Moreover, polishing pad 24 used in the embodiment is not particularly limited, and, for example, it is possible to use any of the pads used heretofore in the prior art. For example, as shown in FIG. 16, a polishing pad on which the several grooves 74 extending concentrically in the circumferential direction are formed on the surface may be used.

Particularly, in polishing pad 24 where this kind of groove 74 is formed on the surface, when polishing, it is difficult to remove the polishing detritus that has entered and accumulated in grooves 74. When the inventors of the present invention were conducting their investigations, in polishing pad 24, the dimensions of the depth of groove 24, even when maintained adequately, by the entry and accumulation of polishing detritus in grooves 74, were rendered effectively insufficient and it was observed that this exerted a negative effect on polishing function.

Figure 17:
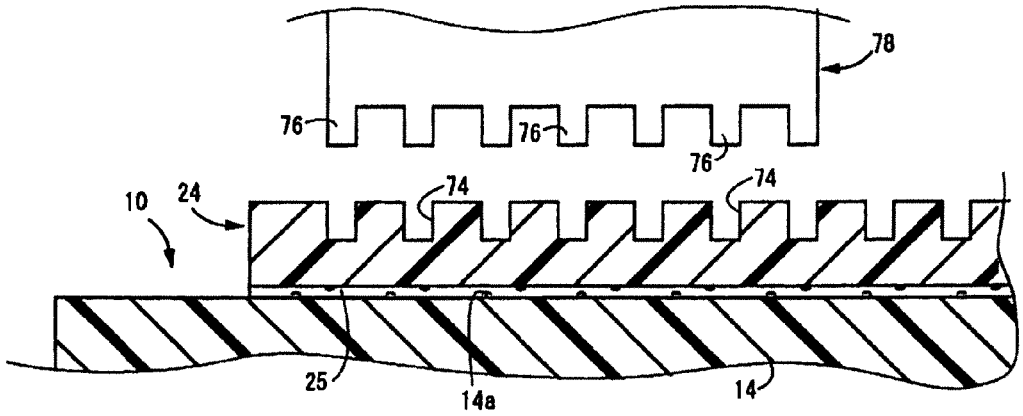
FIG. 17 is an explanatory drawing corresponding to the cross section between XVII and XVII in FIG. 16 for the purpose of showing the regeneration process of the polishing pad on the polishing pad sub plate shown in FIG. 16.
Figure 18:
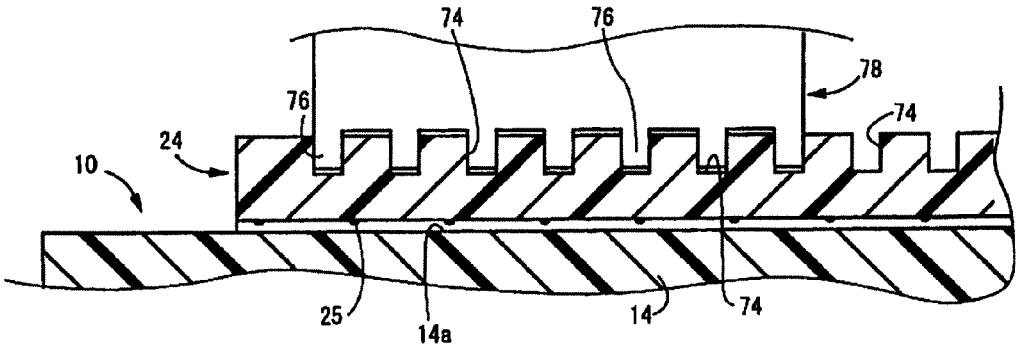
FIG. 18 is a drawing explaining FIG. 17 that explains a separate method of the regeneration process of the polishing pad shown in FIG. 17.

Therefore, as one embodiment of a regeneration method of polishing pad 24, as shown in FIGS. 17 through 18, using a comb-like reforming tool 78 equipped with multiple process use teeth 76 possessing a pitch size conforming to the size of grooves 74 formed in polishing pad 24, by moving each of these teeth 76 relative to and along grooves 74, this is effective in removing matter accumulated in groove 74 by scratching it out.

Moreover, the form of the teeth 76 in reforming tool 78 is not particularly limited to the square shape shown in the Figures, and those tips may use any shape taking into account as well the shape of groove 74 of polishing pad 24, including circular shapes, trapezoidal shapes and V shaped teeth. Moreover, any number of teeth 76 of the reforming tool 78 may be used and, for example, it is possible to be able to (sic) clean out all of grooves 74 at one time. Moreover, the reforming tool 78 may be mounted on the polisher at any time, and the teeth 76 may be forced into the grooves 74 of the polishing pad 24 used in the polishing process.

Additionally, regarding as well the size of each of the teeth 76 in reforming tool 78, for example by making the width dimensions of the teeth smaller than the width dimensions of grooves 74 of polishing pad 24, it is easy to match the position of teeth 76 of reforming tool 78 to grooves 74 of polishing pad 24 and it is thus possible to prevent unexpected injuries to polishing pad 24 and the like. Moreover, in addition to the reforming tool 78 equipped with serrated teeth 76 as shown in each of the Figures, the use of a reforming tool of a brush type that has bundled wire rods inserted into groove 74 of polishing pad 24 or a regeneration device for grooves equipped with rotating type teeth for cleaning out the polishing detritus from groove 74 of polishing pad 24 more proactively, may also be used as appropriate.

If polishing pad sub plate 10 is used as the practice embodiment of the present invention as stated in each case above, it is possible, using a superior process to remove polishing pad 24 from rotation table 12 while preventing injury to polishing pad 24. Moreover, as a result, it is easier to reuse polishing pads. For example, it is possible to reuse polishing pad 24 in the polishing process fixed to polishing pad sub plate 14. Moreover, because the removal of polishing pad 24 from rotation table 12 is quick, it is possible to make more effective use of the operation time of polishing facilities. Additionally, in the manufacturing process of semiconductor substrates, if it is possible to reuse a polishing pad multiple times, wide scale reduction of cost of the manufacture of semiconductor substrates, preservation of raw materials for the manufacture of polishing pads, and the reduction of the disposal volume of polishing pads can contribute to the conservation of the environment.

Incidentally, in the aforementioned practice embodiments, fastening bolt 28 or a negative pressure device 58 and the like are provided to fix polishing pad sub plate 10 to rotation table 12, however, for example, using elastic seal material together with adhesive tape such as double sided tape as necessary, polishing pad sub plate 10 may be mounted upon and fixed solidly to rotation table 12.

Figure 19:
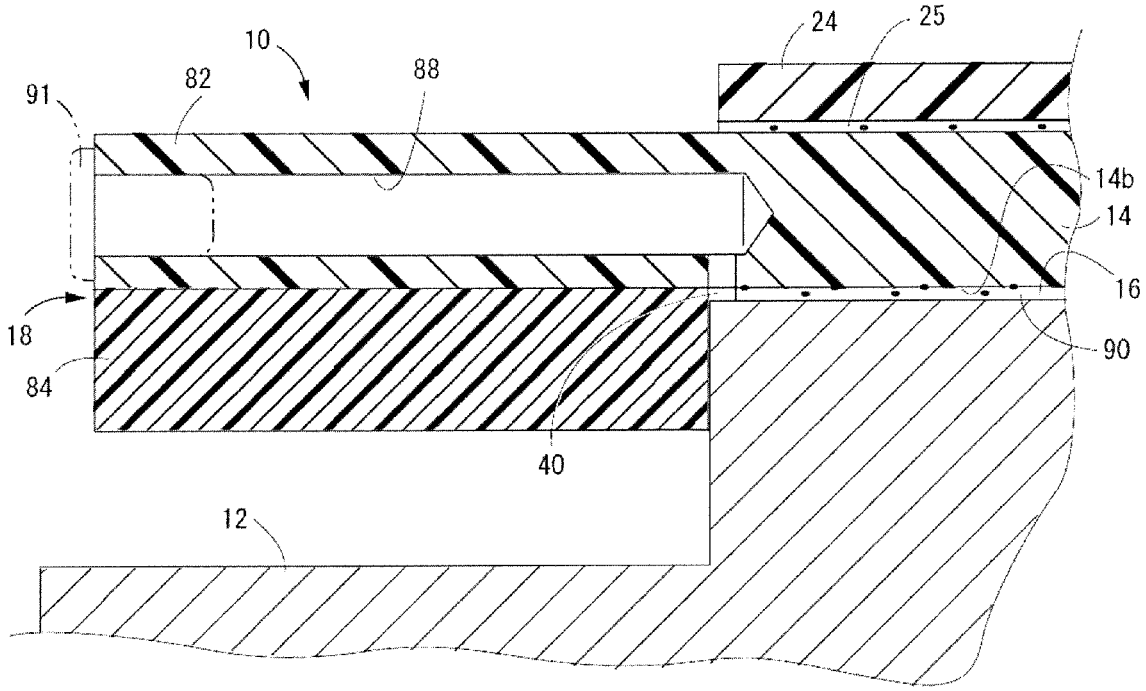
FIG. 19 is a cross sectional drawing showing the polishing pad sub plate in yet a separate embodiment of the present invention.

Concretely, for example, as shown in FIG. 19, the same O ring as shown in aforementioned FIG. 7 may be equipped to fitting ring 18 of polishing pad sub plate 10. Moreover, in the present embodiment, circumferential groove 39 in which is mounted O ring 38, has a cross sectional shape with widened dimension inside than the width at the aperture, and O ring 38 with a cross sectional diametrical dimension larger than the dimension of the aperture of circumferential groove 39 is inserted to the extent of more than half. Accordingly, O ring 38 is in a condition of partial protrusion inside the circumference from the aperture of circumferential groove 39 of fitting ring 18 and is preserved in a mated condition stably and effectively inhibited from being extracted from circumferential groove 39. Incidentally, circumferential groove 39 that is wider on the inside than the aperture may be prepared, for example, by such means as cutting while changing and adjusting the tilt of the cutting tool inserted at the aperture (from the direction of insertion at the aperture).

Moreover, fitting ring 18 of the embodiment may be formed with a divided structure stacked and aligned together in the axial direction (in the vertical direction of the Figure) of torus shaped divided block 84 on outer circumferential edge 82 of sub plate main body 14. Additionally, air removal channel 88 is formed in fitting ring 18*b* extending radially inward from the aperture at the outer circumferential surface, and this air removal channel 88 communicates with internal space 40 formed including the aligned and stacked space between sub plate main body 14 and rotation table 12 by sealing with O ring 38. That is to say the said internal space 40 is connected to the outer air by air removal channel 88.

In the case of a polishing pad sub plate having this kind of structure, when stacked, aligned and mounted from the top of rotation table 12, the space existing between the opposing surfaces of rotation table 12 and sub plate main body 14 is prevented from being sealed in internal space 40 by having been sealed by O ring 38, and can be quickly released to the outside through air removal channel 88. By doing this, the back side 14*b* of sub plate main body 14 can be quickly and stably contacted to upper surface 16 of rotation table 12 while effectively preventing residual air between the two surfaces.

Therefore, in the case of contact by stacking and alignment, it is possible to maintain in a mounted condition at a determined fixing strength, fitting ring 18 of the polishing pad sub plate 10 on the outer circumferential surface of rotation table 12 based on the frictional force and contact force based on the elasticity of O ring 38. Moreover, in the present embodiment, in order to obtain the fixing strength more stably, sub plate main body 14 and the upper surface 16 of rotation table 12 are fixed by adhesive layer 90 of double sided tape (adhesive tape) or adhesives or the like. In addition, when polishing using polishing pad 24 or regenerating polishing pad 24, it is preferable to mount (as shown in the virtual line in FIG. 19) lid part 91 covering the aperture to the external atmosphere of the fitting ring 18 to the air removal channel 88 of polishing pad sub plate 10. By covering air removal channel 88 using this lid part 91, it is possible to prevent the introduction of contaminants into air removal channel 88.

Hereinabove, detailed statements have been made in regard to the embodiments of the present invention, however, the present invention is not limited by the specific wording in these embodiments. For example, to further improve the reinforcement effects of sub plate main body in polishing pad sub plate 10, a reinforcement part extending partially or over the entire circumference on the circumference of the fitting ring 18 may be additionally provided protruding to the outer circumferential edge from the fitting ring 18. Moreover, this kind of reinforcement part is provided so that it protrudes downward in the axial direction from the fitting ring 18 or so that it protrudes upward in the axial direction. The fitting ring 18 because it is removed to the outer circumferential surface from the central part of surface (14*a*) as the pad support surface upon which is mounted polishing pad 24, may also be formed so that it protrudes in an upward axial direction.

Moreover, sub plate main body 14 in the polishing pad sub plate 10 may be supplied in a size and shape that can at least extend to and support the entire surface of the polishing pad, but in any case it is not necessary that it cover the entire extent of the upper surface 16 of rotation table 12. Additionally, it is acceptable if the fitting ring 18 of the polishing pad sub plate 10 is able to exhibit the fixing of the position of fitting ring 18 with regard to rotation table 12, and it is not essential that it be formed continuously across the entire circumference in the circumferential direction.

Figure 20:
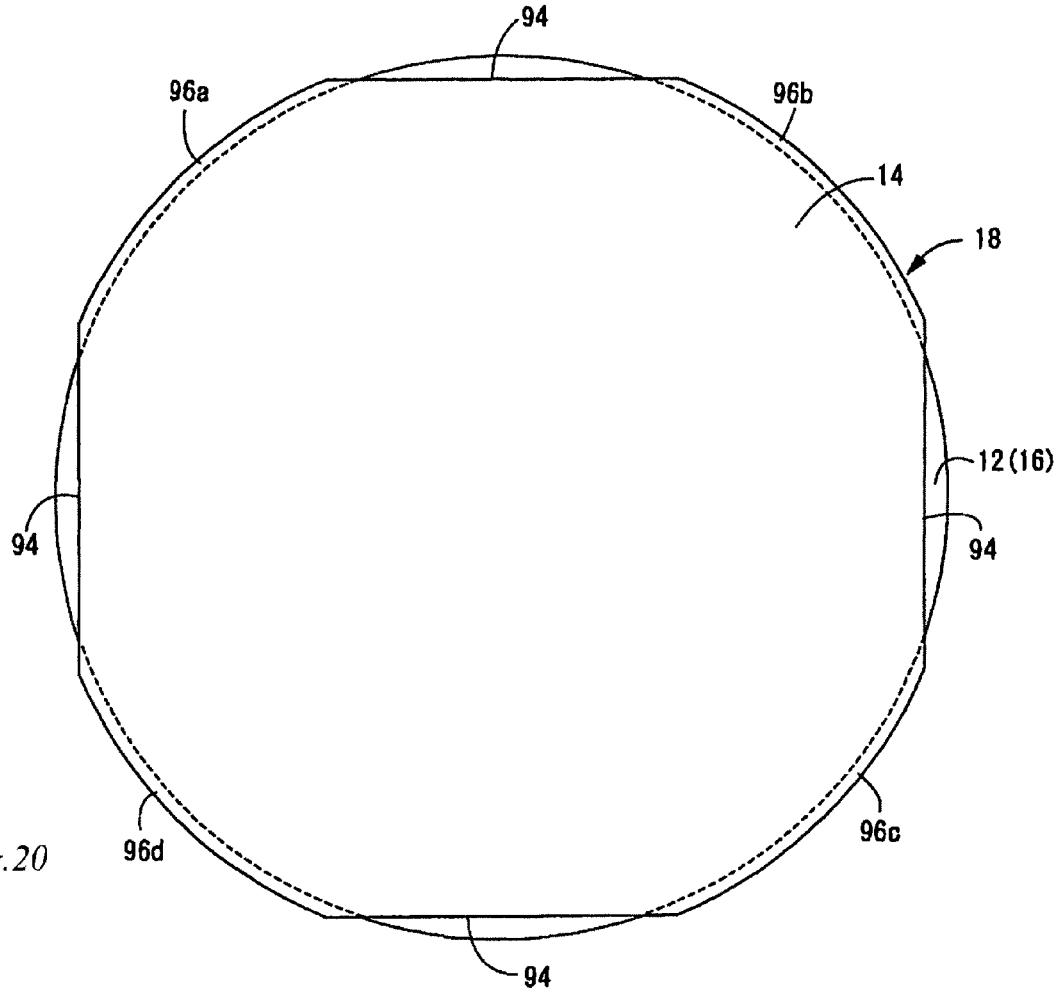
FIG. 20 is a horizontal drawing showing the polishing pad sub plate in yet a separate embodiment of the present invention.
Figure 21:
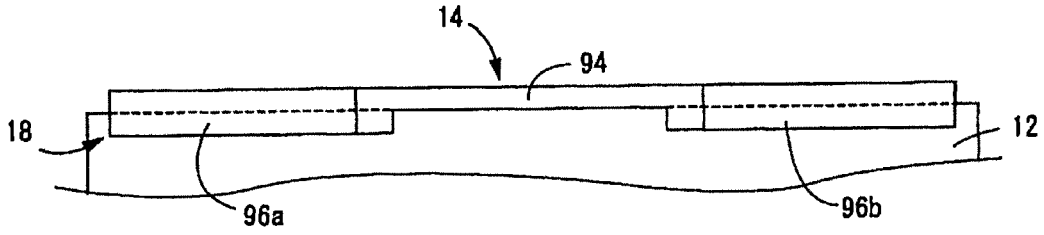
FIG. 21 is a frontal drawing showing the polishing pad sub plate shown in FIG. 20.
Figure 22:
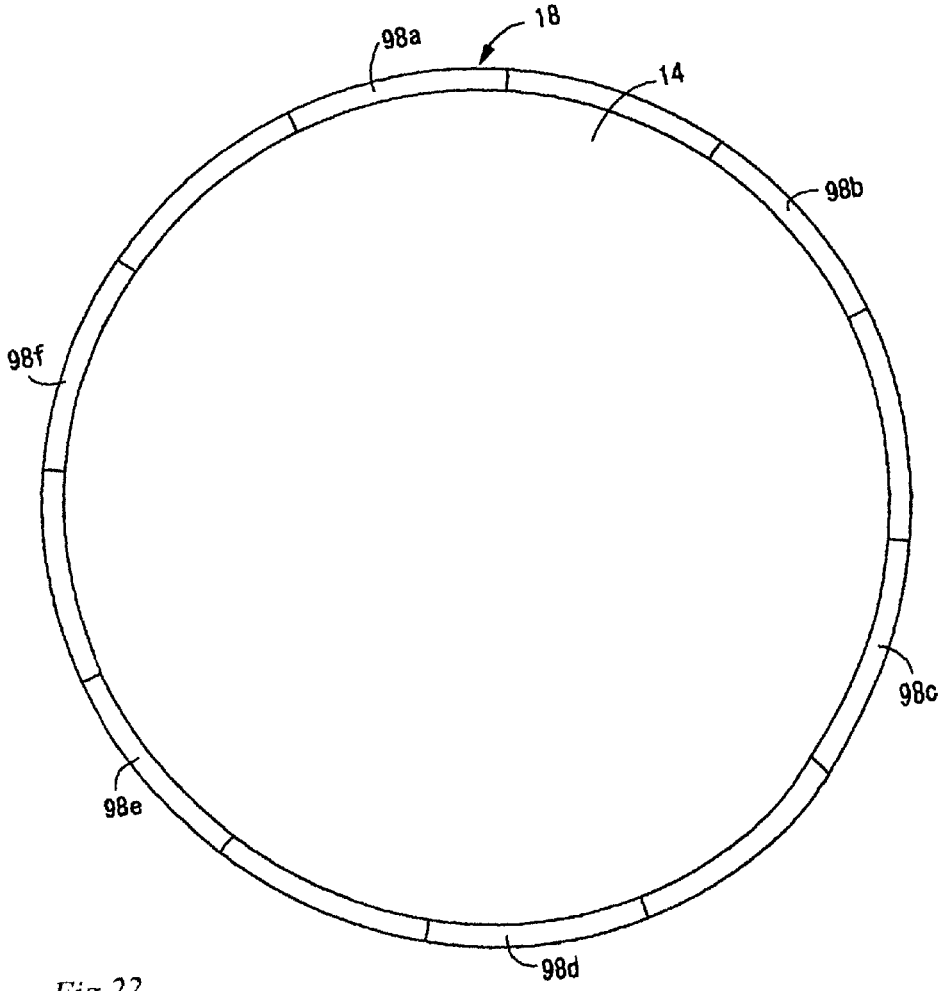
FIG. 22 is a lower surface view drawing showing the polishing pad sub plate in yet a separate embodiment practiced according to the present invention.
Figure 23:
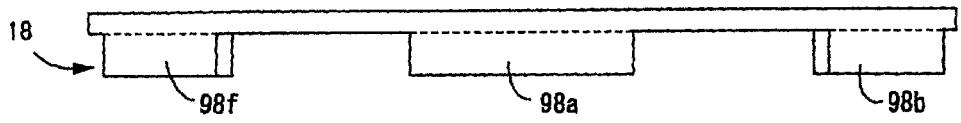
FIG. 23 is a frontal drawing of the polishing pad sub plate shown in FIG. 20.

For example, as shown in FIGS. 20 through 21, it is possible to use an embodiment that partially exposes the upper surface 16 of rotation table 12 by providing notch 94 cut in an appropriate size (in a part where it is not necessary to support the polishing pad) of the outer edge of sub plate main body 14. Or, alternatively, as shown in FIGS. 20 through 21 and 22 through 23, it is possible to form the fitting ring 18 in multiple separate structures 96 a through d and 98 a through f divided along the circumference. Moreover, by dividing the fitting ring 18 along the circumference, the surface of sub plate main body 14 stacked and aligned on upper surface 16 of rotation table 12 even at the outer edge can be directly observed and there is the advantage that it is possible to confirm the observation of the mounted condition of the sub plate main body 14 on the rotation table 12. However, the number, sizes and shapes of notch 94 are not limited nor are the shape, size or number of division of each part of fitting ring 18. In the several notches 94 or the several divisions of the fitting ring 18 it is acceptable to provide relatively different sizes and shapes and the like.

The following numbers conform to the following items in the drawings:

10: polishing pad sub plate
12: rotation table
14: sub plate main body, 14*a*: surface, 14*b*: back surface
16: upper surface
18: fitting ring
20: inner circumferential surface
22: external circumferential surface
24: polishing pad
26: cushion layer
28: fastening bolt
30: bolt free holes
32: bolt holes
34: fastening bolts
36: bolt holes
38: O ring (seal part)
40: internal space
42: annular elastic body (seal part)
44: annular pressing part
46: tightened bolt
48: tightened nut
50: compressed fluid pass
52: one touch connector
56: connection aperture
58: external pipeline
60: jack-bolts
62: through screw holes
64: polisher main body
66: contact block
68: contact projections
70: non-contact part
72: depression
74: groove
76: teeth
78: reforming tool.

What is claimed is:

1. A method for regenerating a polishing pad for polishing semiconductor wafers comprising:

supplying a polishing pad support surface on a polishing pad sub plate, equipping an upper surface of a polisher rotation table with a sub plate main body, together with creating said polishing pad support surface to which said polishing pad is stacked, aligned and fixed by means of a central surface portion of said sub plate main body, fashioning a fitting ring to an outer edge of the said sub plate main body, which ring is mated to an external circumference of said polisher rotation table, and protruding in the downward direction guided by an external circumferential surface of said polisher rotation table, said polishing pad can be detached from the rotation table, and regenerating the surface of said polishing pad wherein said polishing pad is fixed by the fitting ring to said polishing pad supporting surface of said polishing pad sub plate.

2. The method according to claim 1 wherein an adhesion layer improving adhesion is supplied at a contact surface between said pad sub plate and said polisher rotation table.

3. The method according to claim 1 wherein an air removal channel is supplied to said fitting ring to improve adhesion at a contact surface between said sub plate and said polisher rotation table.

4. The method according to claim 1 wherein concentric circular grooves are provided to the surface of said polishing pad and removing material deposited or accumulating in the grooves during polishing.

5. The method according to claim 1 wherein the fitting ring is stably positioned on the outer circumferential surface of said polisher rotation table based on the frictional force and elastic contact force of an O-ring sealing a space between the fitting ring and said polisher rotation table.

* * * * *